US006852068B2

(12) United States Patent
Ogawa

(10) Patent No.: US 6,852,068 B2
(45) Date of Patent: Feb. 8, 2005

(54) TRAINING MACHINE, IMAGE OUTPUT PROCESSING DEVICE AND METHOD, AND RECORDING MEDIUM WHICH STORES IMAGE OUTPUTTING PROGRAMS

(75) Inventor: Kiyotaka Ogawa, Tokyo (JP)

(73) Assignee: CSK Corporation, Tokyo (JP)

( * ) Notice: Subject to any disclaimer, the term of this patent is extended or adjusted under 35 U.S.C. 154(b) by 0 days.

(21) Appl. No.: 10/395,212

(22) Filed: Mar. 25, 2003

(65) Prior Publication Data

US 2003/0181291 A1 Sep. 25, 2003

Related U.S. Application Data

(60) Division of application No. 09/659,744, filed on Sep. 11, 2000, and a continuation of application No. PCT/JP99/00466, filed on Feb. 3, 1999.

(30) Foreign Application Priority Data

Mar. 9, 1998 (JP) ..... 10-73014

(51) Int. Cl.[7] ..... A63B 21/00
(52) U.S. Cl. ..... 482/8; 482/1; 482/900
(58) Field of Search ..... 482/1–9, 51, 54, 482/57, 900–902; 434/247

(56) References Cited

U.S. PATENT DOCUMENTS 6,152,856 A * 11/2000 Studor et al. ..... 482/8
6,334,837 B1 * 1/2002 Hein et al. ..... 482/8
6,458,060 B1 * 10/2002 Watterson et al. ..... 482/54

FOREIGN PATENT DOCUMENTS

| | | |
|---|---|---|
| JP | 61-45726 | 3/1986 |
| JP | 7-250919 | 10/1995 |
| JP | 8-503142 | 4/1996 |
| JP | 9-173500 | 7/1997 |
| WO | WO 94/02904 | 3/1994 |

* cited by examiner

*Primary Examiner*—Glenn E. Richmon
(74) *Attorney, Agent, or Firm*—Pillsbury Winthrop LLP

(57) ABSTRACT

A training machine including a load unit (13) and a pedal (12) or the like for providing an exerciser with predetermined exercise and a display (17) for displaying an image, further including a storage unit (24) for storing a reference range of the heart rate of the exerciser being exercising, a storage unit (24) for storing a plurality of types of images, a heart rate sensor (21A) for sensing the heart rate of the exerciser, a sensor signal detection processing unit and display-audio output processing unit (27B, 27A) for judging whether the exercising state of the exerciser is proper, wherein the display-audio output processing unit (27A) retrieves the image corresponding to the exercising state from the storage unit (24) and displays it on a display unit (17).

2 Claims, 21 Drawing Sheets

TRAINING MACHINE, IMAGE OUTPUT PROCESSING DEVICE AND METHOD, AND RECORDING MEDIUM WHICH STORES IMAGE OUTPUTTING PROGRAMS

This is a divisional application of U.S. patent application Ser. No. 09/659,744 filed Sep. 11, 2000; and this is a continuation application of PCT/JP99/00466 filed on Feb. 3, 1999, the contents of both applications are incorporated herein by reference. This patent application also claims priority based on Japanese Patent Application H 10-73014 filed on Mar. 9, 1998, the contents of which are incorporated herein by reference.

BACKGROUND OF THE INVENTION

1. Field of the Invention

The present invention relates to a training machine used for the purpose of fitness and aerobics by which to improve the heart-lung related function and to burn fat, a training machine used for supporting or accelerating his/her exercise in the course of rehabilitation such as medical training for the body and mental state, or a training machine for use as his/her entertainment and leisure and so on. It particularly relates to a training machine for displaying images for the exerciser. Moreover, the present invention relates to an image output processing device and an image output processing method for displaying the image for the exerciser. Moreover, the present invention relates to a recording medium which stores the image outputting program for displaying the image for the exerciser.

2. Description of the Related Art

Conventionally, training apparatus provides one with an exercise for enhancing healthiness, medical training, or certain entertainment and leisure. For example, as a training machine, there are known a bike machine reproducing the exercise by stepping on the pedal of a bicycle, a treadmill reproducing the running, a chest press and a shoulder press improving the muscle force of the chest and shoulder, or a rowing machine reproducing the exercise of rowing a boat, and so on.

In these training machines, the exercise itself provided by the training machines is oftentimes mechanical and boring, and one usually gets bored within a short period of time unless one has to do the exercise in order to recover from illness or out of necessity. For example, when exercising by pedaling the bike machine, the exerciser often tries to kill time by looking at a magazine or television.

Moreover, in general, the exercisers often do not know about which training machine to use and how much exercise using such a machine will be effective. Moreover, there are many occasions where the exerciser thinks and misunderstands that the best way to obtain the maximum effect is to continue exercising under painful conditions. Thus, there are occasions where the exercisers perform unnecessarily severe exercise.

Moreover, in the conventional training machines, some have a mechanism generating a load for the exercise, output a load level by a lamp for the types of load generation, and display an image. Though in this training machine the load level is indicated to the exerciser by the lamp, it is difficult to let the exerciser know whether it is a proper exercise by providing only this load level information.

The U.S. Techtricks, Inc. is developing a bike machine where graphics move relative to the pedal. Though in this bike machine the boredom of the exerciser can be prevented by the graphics, the exerciser would not know whether it is an appropriate exercise or not.

In Japanese Patent Application Laid-Open No. S61-45726, a health information apparatus is disclosed in which a pulse rate serving as a body's physiological information is converted to an electric signal by a sensor, said electric signal is input to an arithmetic circuit so as to select an address of the audio data memory, the digital data of said selected address is converted to an audio analog signal by an audio synthesis circuit, and said analog signal is output from a speaker as an audio sound via a power amplifier. However, in this health information apparatus, there are problems where the boredom in the exercise cannot be prevented and more over the information will be lost if the exerciser misses hearing the audio sound since the information is given to the exerciser by the audio sound.

As described above, in the conventional training machines, whether the exercise is appropriate cannot be easily and properly grasped by the exerciser.

SUMMARY OF THE INVENTION

It is, therefore, an object of the present invention to provide a training machine, image output processing device, image output processing method and recording medium storing image output program capable of letting the exerciser know whether the exercise is appropriate or not. Moreover, it is another object of the present invention to provide a training machine, image output processing device, image output processing method and recording medium storing image output program capable of outputting an effective image for the exercise. This object is achieved by combinations described in the independent claims. The dependent claims define further advantageous and exemplary combinations of the present invention.

According to an aspect of the present invention, there is provided a training machine according to a first embodiment of the present invention, equipped with an exercising portion that provides an exerciser with a predetermined exercise and a display unit that displays an image of activity associated with the exercise, the training machine comprising: an image storing unit which stores plural types of images; a sensor which detects body information of the exerciser changing with the exercise; a reference range storing unit which stores a reference range of the body information of the exerciser in the exercise; a state detection unit which detects whether the body information detected by the sensor belongs to the reference range, for plural times within a predetermined time duration, so as to detect whether an exercising state of the exerciser is proper based on detection results carried out for plural times; and an image display control unit which extracts the image associated with either the proper state or the improper state of the exercising state detected by the state detection unit, from the image storing unit, so as to be displayed by the display unit.

The body information of the exerciser may be the heart rate (pulse rate) of the exerciser. The image displaying control unit may cause an image indicative of the relationship between the heart rate detected by the sensor and the reference range, to be displayed on the display unit.

The state detection unit may detect as a proper state, the event that the heart rate still consecutively belongs to the reference range during the predetermined time duration, while the state detection unit may detect as an improper state in the event that the heart rate continues to be out of the reference range beyond a predetermined extension time, in the predetermined time duration.

A training machine may further comprise an extension time setting unit, which sets a predetermined extension time.

The reference range may lie in a range of less than or equal to a predetermined heart rate and greater or equal to a predetermined heart rate. Moreover, a training machine may further comprise a reference range setting unit which sets the reference range.

The reference range storing unit may store a plurality of the reference ranges in association with each time from a predetermined point, and wherein the state detection unit may detect whether an exercising state of the exerciser is a proper state or an improper sate, based on the reference range associated with time from the predetermined point and the heart rate. The time from the predetermined point may be time from a point where a warm-up of the exercise ends or time during which a cool-down of the exercise ends from a point where a warm-up of the exercise starts. A training machine may further comprise a reference time setting unit which sets time corresponding to the reference range. Moreover, the reference range storing unit may store a plurality of the reference ranges corresponding to respective exercise modes of the exercise, and further comprising an exercise mode selection unit which selects a single exercise mode from a plurality of the exercise modes, the state detection unit detecting whether an exercising state of the exerciser is proper, based on the reference range corresponding to the selected exercise mode.

A training machine may further comprise a perception data outputting unit which outputs perception data when the heart rate is close to a boundary of the reference rage. The perception data outputting unit may output the perception data based on a difference between the heart rate and a boundary value of the reference range. The perception data outputting unit may output the perception data based on a direction of change in the heart rate and a difference between the heart rate and the boundary value of the reference range.

Moreover, a training machine may further comprise an exercise content measuring unit which measures an exercise content with regard to the exercise. The exercise content may be data based on at least one of time, exercise amount, heart rate during the exercise and a gross amount of exercise in the exercise.

The image display control unit may retrieve an image corresponding to the proper state or the improper state of the exercising state detected by the state detection unit and corresponding to the exercise content measured by the exercise content measuring unit, so as to be displayed on the display unit.

The exercise content may include data of the exercise amount, and the image displayed by the image display control unit includes a figure corresponding to the exercise amount. A training machine may further comprise an evaluation valued is play control unit which causes to display on the display unit an evaluation value corresponding the exercise content.

A training machine may further comprise an exercise content storing unit which stores the exercise content measured by the exercise content measuring unit. The exercise content may be stored corresponding to each exerciser. A training machine may further comprise an individual comparison displaying control unit which causes to display on the display unit a same exerciser's exercise content stored in the exercise content storing unit for plural times. A training machine may further comprise a plural-members comparison displaying control unit which causes to display on the display unit, the exercise content of plural members stored in the exercise content storing unit. A training machine may further comprise a communication unit which sends to an external portion, the exercise content stored in the exercise content storing unit via communication lines, and which receives an exercise content from the external portion via the communication lines so as to be stored in the exercise content storing unit.

In a training machine according to the present invention, the exercising portion comprises a load device which generates a load of the exercise and a load control unit which adjusts the load. The load control unit may lessen an amplitude of fluctuation in the load generated by the load device when an increasing rate of heart rate with respect to time is high. The load control unit may increase an amplitude of fluctuation in the load generated by the load device when an increasing rate of heart rate with respect to time is low. The load control unit may lessen an amplitude of fluctuation in the load generated by the load device when an increasing rate of heart rate with respect to time is high, while the load control unit may increase an amplitude of fluctuation in the load generated by the load device when an increasing rate of heart rate with respect to time is low.

A training machine may further comprise a load reference value storing unit which stores a load reference value serving as a reference of the load, and the load control unit may generate the load based on the load reference value stored in the load reference value storing unit. The load reference value of the load reference value storing unit is associated with the image of the image storing unit, and the load control unit generates the load on the basis of the load reference value associated with the image displayed by the image display control unit. The load control unit may generate the load based on the load reference value associated with part of a plurality of the images displayed by the image display control unit.

Moreover, a training machine may further comprise: a detection unit which detects that the change of the heart rate is less than a predetermined permissible change value while the load of the load device changes; and a warning output unit which outputs a warning when the detection unit detects that the change of the heart rate is less than the predetermined permissible change value. Moreover, a training machine may further comprise: a detection unit which detects that the change of the heart rate is greater than a predetermined permissible change value while the load of the load device changes; and a warning output unit which outputs a warning when the detection unit detects that the change of the heart rate is greater than the predetermined permissible change value.

A training machine according to a second embodiment, equipped with an exercising portion that provides an exerciser with a predetermined exercise and a display unit that displays an image of activity associated with the exercise; the training machine comprises: a sequence storing unit which stores a sequence indicating the order of a plurality of display statuses specifying the image; a display status image storing unit which stores an image associated with the each display status; a display status controlling unit which controls the present display status of the exerciser; a sensor which detects body information of the exerciser changing with the exercise; a transition detecting unit which detects whether the present display status is transited to a display status of the next sequence stored in the sequence storing unit, based on the body information detected by the sensor; and a display status image display control unit which transits the present display status controlled by the display status controlling unit to the display status of the next sequence when the transition detecting unit detects that the status is transited to the display status of the next sequence, and displays on the display unit the image associates with the transited display status. The body information may be a heart rate of the exerciser.

Moreover, a training machine may further comprise an exercise-amount sensor which detects an exercising amount of the exerciser, wherein the transition detecting unit may detect whether the present display status is to be transited to the display status of the next sequence, based on the detected heart rate and the detected exercising amount. Moreover, the sequence has a part which branches out to a plurality of display statuses right after a display status, and the transition detecting unit, moreover, may select the display status which transits based on the heart rate, when there are a plurality of display statuses right after the present display status.

An image output processing apparatus, according to the first embodiment of the present invention, which displays on a display unit that displays an image for an exerciser, the image of activity associated with an exercise of the exerciser, the apparatus comprising: an image storing unit which stores plural types of the images; an input unit which inputs the exerciser's body information changing with the exercise; a reference range storing unit which stores a reference range related to the body information of the exerciser; a state detection unit which detects for plural times whether the body information input by said input unit belongs to the reference range, and detects whether an exercising state of the exerciser is proper based on detection results carried out for plural times; and an image display control unit which extracts the image associated with either the proper state or the improper state of the exercising state detected by said state detection unit, from said image storing unit, so as to be displayed by the display unit. The body information may be a heart rate of the exerciser.

An image output processing apparatus, according to the second embodiment of the present invention, which displays on a display unit that displays an image for an exerciser, the image of activity associated with an exercise of the exerciser, the image output processing unit comprising: a sequence storing unit which stores a sequence indicating the order of a plurality of display statuses specifying the image; a display status image storing unit which stores an image associated with said each display status; a display status controlling unit which controls the present display status of the exerciser; an input unit which inputs body information that changes as the exerciser exercises; a transition detecting unit which whether the present display status is transited to a display status of the next sequence stored in the sequence storing unit, based on the body information detected by the input unit; and a display status image display control unit which transits the present display status controlled by the display status controlling unit to the display status of the next sequence when the transition detecting unit detects that the status is transited to the display status of the next sequence, and displays on the display unit the image associates with the transited display status. The body information may be a heart rate of the exerciser.

An image output processing method according to the first embodiment, of displaying on a display unit that displays an image for an exerciser, the image of activity associated with an exercise of the exerciser, the method comprising the steps of: storing a reference range related to body information that changes with an exercise of the exerciser, in a reference range storing unit; detecting the body information of the exerciser; detecting whether the body information detected by the detecting belongs to the reference range, for plural times within a predetermined time duration, and detecting, based on detection results carried out for plural times, whether an exercising state of the exerciser is proper.

An image output processing method, according to the second embodiment, of displaying on a display unit that displays an image for an exerciser, the image of activity associated with an exercise of the exerciser, the method comprising the steps of: inputting body information that changes as the exerciser exercises; detecting whether the present display status specifying a displayed image is to be transited to a display status of the next sequence, based on the body information detected by the input; and transiting the present display status to the display status of the next sequence when the detecting detects that the status is transited to the display status of the next sequence, and displaying on the display unit the image associates with the transited display status.

A recording medium, according to the first embodiment, which stores a program executed by a computer, is characterized by storing: an image associated with exercise for plural types of exercisers; an input program which inputs to the computer, body information that changes with the exercise of the exercisers; a reference range storing program which stores in the computer a reference range related to the body information of the exerciser; state detection program which detects whether the body information input by executing the input program belongs to the reference range stored by executing the reference range storing program by the computer, for plural times within a predetermined time duration, and detects by using the computer, based on detection results carried out for plural times, whether an exercising state of the exerciser is proper; and an output program which outputs the image corresponding to the proper state of the improper state of the exercising state detected by executing the state detection program by the computer, from plural types of the images so as to be output.

This summary of the invention does not necessarily describe all necessary features of the present invention. The present invention may also be a sub-combination of the above described features. The above and other features and advantages of the present invention will become more apparent from the following description of embodiments taken in conjunction with the accompanying drawings.

DETAILED DESCRIPTION OF THE INVENTION

The invention will now be described based on the preferred embodiments, which do not intend to limit the scope of the present invention. All of the features and the combinations thereof described in the embodiment are not necessarily essential to the invention.

Figure 1:
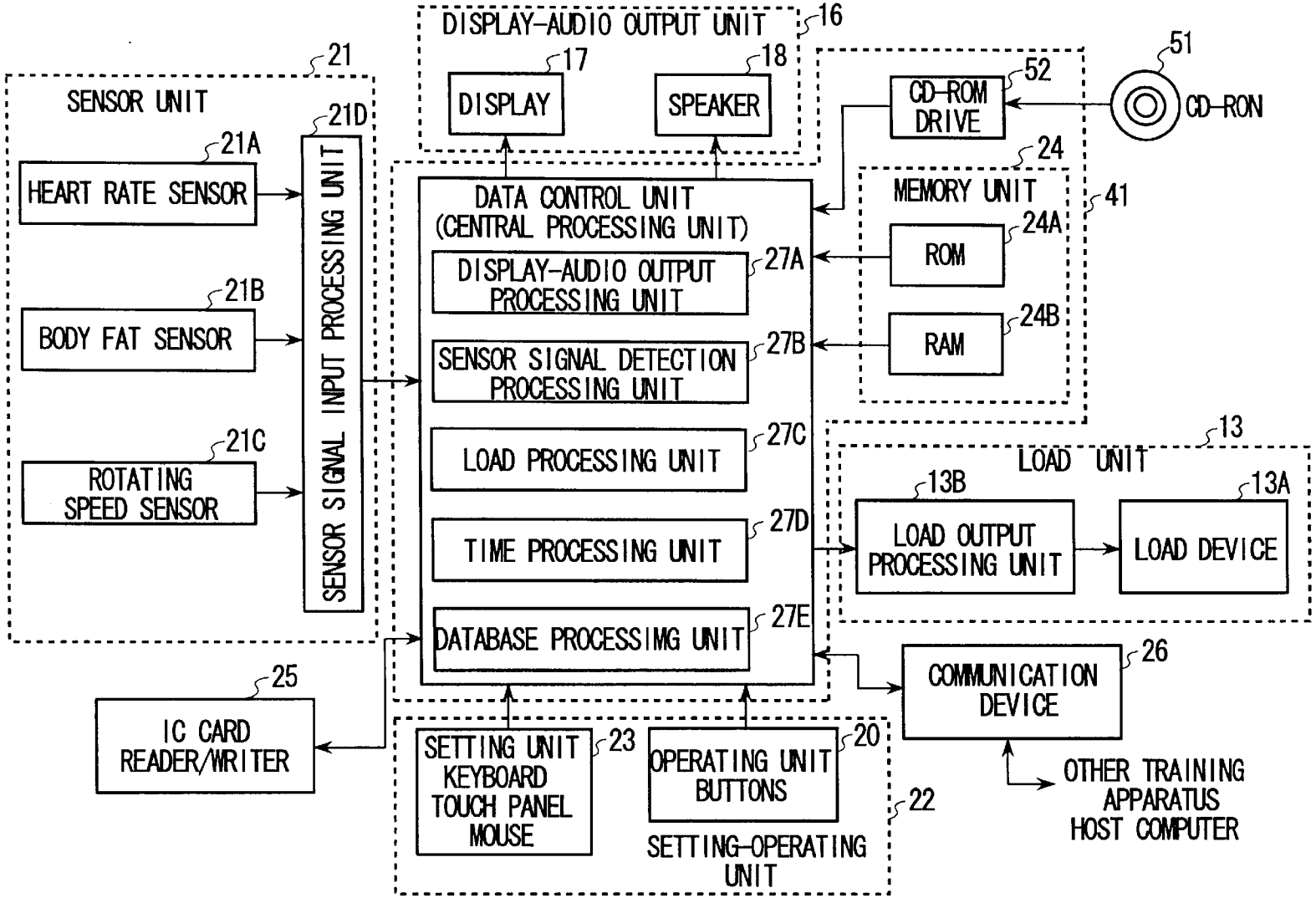
FIG. 1 is a block diagram showing the configuration of the processing system for an image output processing device and training machine according to a first embodiment of the present invention.

FIG. 1 is a block diagram showing the configuration of the processing system for an image output processing device and training machine according to the first embodiment of the present invention. According to the present embodiment, a bike machine will now be described as an example of the training machine.

The training machine 10 comprises a sensor unit 21 which detects the exercising condition of the exerciser, a display-voice output unit 16 (also used interchangeably as display-audio output unit 16 hereinafter) which displays images and produces voice (audio) outputs, a setting and operating unit 22 which is to be used to effect various settings and control, a load unit 13 which controls the load necessary for exercise, an IC card reader/writer 25, a communication device 26 for data transmission to or reception from an external source, a memory unit 24 which is used to store various programs and data, a data operating unit (central processing unit) 27 which performs various data processing while controlling the above-mentioned units, and an image output processing unit 41 which includes a CD-ROM drive 52.

The exercising condition of the exerciser in the present invention is the physical condition of the exerciser during exercise.

It is to be noted that a personal computer (PC) for general use or a game machine, such as DreamCast (trade mark), can be used as the image output processing device 41.

The CD-ROM drive 52 reads data or program from CD-ROM 51, which is an example of the storage medium, and supplies it to a data operating unit 27. The storage medium of the present invention can be any of optical storage media, such as CD-ROM 51 or DVD, optical magnetic storage media, such as MO, magnetic storage media, such as floppy disk, semiconductor storage media, such as IC card, and all other media capable of storing programs related hereto.

The sensor unit 21 comprises a heart rate sensor 21A which detects the heart rate (pulse rate) as an example of the physical information on the exerciser and converts it into an electric signal, a body fat sensor 21B used to measure the body fat of the exerciser, a rotating speed sensor 21C which derives the electrical signal proportional to the rotating speed of the rotating shaft of the load unit 13 as information for the measurement of the amount of exercise undertaken by the exerciser, and a sensor signal input processing unit 21D which converts the analog electric signals from the above-mentioned sensors 21A, 21B and 21C into the digital signals that can be taken into the computer. The physical information in the present invention is the information that changes with the progress of exercise undertaken by the exerciser but can be obtained through measurement of the physical condition of the exerciser during exercise, such information including not only the above-mentioned heart rate but also the information available from the electrocardiogram or electro-myogram of the exerciser for example.

The setting and operating unit 22 includes an operating unit 20 and a setting unit 23. The operating unit 20, which allows the exerciser to mainly input various settings for the exercise desired, is equipped with a plurality of buttons, such as the cursor key for moving the cursor on the screen right or left, up or down and the buttons for inputting such control instructions as start, stop, switch or cancel. According to the present embodiment, a desired exercise mode is selected by the exerciser from a plurality of exercise modes on the operating unit 20. The exercise modes include the heart-lung function improving mode, the beginner or fat-burning mode and the manual mode.

The heart-lung function improving mode is the exercise mode based on the theory of exercise which holds that an exercise for a certain length of time with the heart rate maintained at 60 to 85 percent of the maximum heart rate can strengthen the cardiopulmonary function of the exerciser. In other words, it is the exercise mode in which exercise is undertaken for a predetermined length of time while maintaining the heart rate at 60 to 85 percent of the maximum heart rate. Selection of the heart-lung function improving mode on the operating unit 20 will effect the setting of such values as the predetermined exercise time, the load level, and the reference range of heat rate during exercise (e.g., upper limit value and lower limit value) for the heart-lung function improving mode stored in the memory unit 24.

The beginner or fat-burning mode is the exercise mode based on the theory of exercise which holds that an exercise undertaken for 10 minutes or more with the heart rate maintained at 50 to 65 percent of the maximum heart rate can burn body fat effectively. In other words, it is the exercise mode in which exercise is undertaken for a predetermined length of time (10 minutes or more) while maintaining the heart rate at 50 to 65 percent of the maximum heart rate. Selection of the beginner or fat-burning mode on the operating unit 20 will effect the setting of such values as the predetermined exercise time, the load level, and the reference range of heat rate during exercise (e.g., upper limit value and lower limit value) for the beginner or fat-burning mode stored in the memory unit 24.

The manual mode is the exercise mode which allows the exerciser to set the exercise time, the load during exercise, the reference range of heart rate, etc., by his/her own free choice. In the manual mode, the settings can be changed freely on the operating unit 20 during the exercise. Selection of the manual mode on the operating unit 20 will effect the setting of the values inputted from the operating unit 20. The load level for exercise in the manual mode can be set either by inputting a desired load level on the operating unit 20 or by inputting a wattage, which is the work load, or a metz value, which is the work load with the body weight taken into consideration, on the operating unit 20, which, in turn, sets the exercise load level, total exercise time, etc., corresponding to the value inputted as mentioned above. It is also possible to input the number of calories to be consumed by exercise from the operating unit 20, thereby setting such values as exercise time, exercise load and rotating speed corresponding to the inputted number of calories. The load for exercise corresponding to the inputted value as well as the exercise time, exercise load, rotating speed, etc., corresponding to the value of calories is stored in the memory unit 24, all related to inputted values or the inputted numbers of calories.

In addition to the above-described modes, the random mode (game mode) can be selected, in which the data operating unit 27 randomly sets the type of image to be displayed (the kind of fish to be caught according to the present embodiment), the changing load pattern, etc. In each of the above-described modes, when the setting stored in the memory unit 24 is to be set, the values set will be ones predetermined generally by age and sex. According to the present embodiment, the exerciser can change the preset values, such as the upper limit value and lower limit value, to suit his or her own individual differences.

The setting unit 23 mainly allows the owner of the training machine to set various conditions for exercise or input instructions for the maintenance thereof. The setting unit 23 can employ a keyboard, touch panel or mouse as the input device.

The display-voice output unit 16 comprises a display 17 which displays images according to the image data input from the data operating unit 27 and a speaker 18 which produces messages, alarms, etc., according to the voice data input from the data operating unit 27.

The memory unit 24 is provided with a ROM 24A which stores programs and data to be processed by the data operating unit 27 and a RAM 24B which stores temporary data and output data to be processed by the data operating unit 27. Data stored by the memory unit 24 include the setting information corresponding to the exercise mode, the information managed by the database processing unit 27E, a plurality of the image data to be displayed by the display-voice output unit 16, and the voice data, such as messages or alarms, to be output by the display-voice output unit 16. Programs can be replaced with other programs transmitted from outside via a storage medium, such as CD-ROM 51, or a communication device 26. Data in the memory unit 24 can be read into a recording medium, such as a floppy disk.

The load unit 13 is provided with a load device 13A which produces a predetermined load (torque) to work on the rotation of the member rotated by the pumping of the pedals 12S to be described later and a load output processing unit 13B which controls the load to be produced by the load unit 13 according to the load data output from the data control unit 27. The load device 13A can be a powder clutch capable of changing the rotating torque by the current applied, an eddy-current brake capable of changing the rotating torque by the use of eddy current, a generator, servo motor, any mechanism capable of changing the rotating torque by the friction between the belt and the rotating member (drum) and the drum, or any mechanism capable of changing the rotating torque to work on the above-mentioned rotating member by changing the distance between a magnet means and the above-mentioned rotating member. According to the present embodiment, the load output processing unit 13B controls the load to be generated by converting the load data input from the data control unit 27 into analog signals and outputting them to the load device 13A.

The data control unit 27, which serves as the functional equivalent to the CPU of a computer, comprises a display-audio output processing unit 27A, a sensor signal detection processing unit 27B, a load processing unit 27C, a time processing unit 27D and a database processing unit 27E.

The display-audio output processing unit 27A performs the display output processing for outputting image data to a display 17 and the voice output processing for outputting voice data to a speaker 18.

The display output processing performed by the display-audio output processing unit 27A includes the processing to output the image data of the images for various settings for exercise to the display-voice output unit 16, the processing to output the image data of the images during exercise to the display-voice output unit 16, and the processing to output the image data of the images showing the results (evaluations) of exercise on completion thereof to the display-voice output unit 16.

The processing to output the image data of the images during exercise to the display-voice output unit 16 will now be explained specifically. According to this present embodiment, images corresponding to the changing display status of the exerciser during exercise are output as the images during exercise; that is, the images of trolling, which are related to the changing display status of the exerciser during exercise, are output as the images during exercise. As for the above-mentioned images for trolling, it is preferred that the fish is represented stereoscopically and that the fish jumps in the air or makes other movements realistically.

The display-audio output processing unit 27A, when the display status of the exerciser immediately after the start of exercise by the exerciser is being controlled as display status 1, which is the initial display status, causes the time processing unit 27D to measure a predetermined time from the point when the detection result that the heart rate of the exerciser belongs to the preset reference range is received from the sensor signal detection processing unit 27B and keeps detecting the detection results showing whether the heart rate remains within the reference range, which are being sent from the sensor signal detection processing unit 27B during said predetermined time. As a result, when it keeps receiving the detection result that the heart rate remains within the reference range, the display-audio output processing unit 27A, judging that the exerciser is now in a proper exercise status, shifts the display status of the exerciser to display status 2, which is the display status after display status 1, meaning a proper exercise status, reads out the image data showing the above-described display status 2 from the memory unit 24 and outputs it to the display-voice output unit 16. According to the present embodiment, the image data for the image of a fish caught on a hook, is used as the image data corresponding to display status 2.

Also, the display-audio output processing unit 27A, when the display status of the exerciser is being controlled as display status 2, causes the time processing unit 27D to measure a predetermined time from the point when the detection result that the heart rate of the exerciser has gone out of the preset reference range is received from the sensor signal detection processing unit 27B and keeps detecting the detection results showing whether the heart rate belongs in the reference range, which are being sent from the sensor signal detection processing unit 27B during said predetermined time. As a result, when it does not receive the detection result that the heart rate belongs in the reference range, the display-audio output processing unit 27A, judging that the exerciser is now in an improper exercise status, which is hazardous for the exerciser or producing no beneficial effects of exercise, shifts the display status of the exerciser to display status 3 or display status 4, which is the display status after display status 2, meaning an improper exercise status, reads out the image data showing the above-described display status 3 or 4 from the memory unit 24 and outputs it to the display-voice output unit 16. According to the present embodiment, the display-audio output processing unit 27A shifts the display status of the exerciser to display status 3 when it detects an improper exercise status where the heart rate of the exerciser is below the reference range and shifts the display status thereof to display status 4 when it detects an improper exercise status where the heart rate thereof is above the reference range. Also, according to the present embodiment, the image data for the image of a fish lost after being unhooked is used as the image data corresponding to display status 3, and the image data for the image of a fish lost with the line snapping is used as the image data corresponding to display status 4.

Also, the display-audio output processing unit 27A, when the display status of the exerciser is being controlled as display status 2, reads out the image based on the total number of revolutions from the start of display status 2 input from the sensor signal detection processing unit 27B, which is also an image related to display status 2, and outputs it to the memory unit 24. According to the present embodiment, the image data are output in such a way that the greater the total number of revolutions after the start of display status 2, the closer to the fish the image will be. And when the total number of revolutions after the start of display status 2 has reached the predetermined number of revolutions, the display-audio output processing unit 27A shifts the display status of the exerciser to display status 5, which is the display status after display status 2, and outputs the image data for the image of a fish landed, or caught, which corresponds to display status 5, and outputs it to the display-voice output unit 16.

The sequences of the above-described display statuses are stored in the memory unit 24. In the sequence according to the present embodiment, as mentioned above, display status 1 is followed by display status 2, and display status 2 is followed by display status 3, display status 4 or display status 5.

Also, the display-audio output processing unit 27A, when the load output by the load unit 13A is changing, outputs an alarm image and/or voice message or the like which gives the alarm to the display-voice output unit 16 when it has detected that the change in heart rate detected by the sensor signal detection processing unit 27*b* is smaller than the predetermined value for the minimum permissible change. Likewise, the display-audio output processing unit 27A, when the load output by the load unit 13A is changing, outputs an alarm image and/or voice message or the like which gives the alarm to the display-voice output unit 16 when it has detected that the change in heart rate detected by the sensor signal detection processing unit 27*b* is larger than the predetermined value for maximum permissible change.

Also, the display-audio output processing unit 27A receives information to be used in the evaluation of the exercise status of the exerciser during exercise and has the information managed by the database processing unit 27E. According to the present embodiment, the display-audio output processing unit 27A receives, as information to be used in evaluation (evaluation values), the number of times display status 5 has occurred after the total number of revolutions after the start of display status 2, which is the proper exercise status during exercise, has reached the preset number of revolutions, that is, the number of fish landed in trolling; the number of times display status 3 or display status 4, which are each improper exercise statuses, have resulted from display status 2, which is a proper exercise status during exercise, that is, the number of fish lost in trolling; the calories consumed during exercise; the wattage of the exercise undertaken; etc. Also, the display-audio output processing unit 27A causes the display 17 to display images corresponding to the amount of exercise undertaken by the exerciser during exercise (e.g., rotating speed×load). According to the present embodiment, the display-audio output processing unit 27A causes the display of a trolling rod bent according to the amount of exercise undertaken and the heaviness of load used.

Moreover, the display-audio output processing unit 27A outputs not only the above-described image data but also other image data, such as the image showing a preset reference range and current heart rate, the image showing the total number of revolutions after the start of display status 2, which is a proper exercise status, the images of instructions and guidance given to the exerciser and the images of characters who give instructions and guidance to the exerciser to the display-voice output unit 16. Moreover, the display-audio output processing unit 27A, when the evaluation of exercise undertaken is above a predetermined level or, for example, the number of fish landed is more than a predetermined number, outputs not only image data with different graphic or occurrence patterns but also image data for a bonus stage, which is given as a present, to the display-voice output unit 16. It also outputs image data for such images as produced special graphic displays or score displays.

Between images of a game, the display-audio output processing unit 27A can output to the display-voice output unit 16 image data for images used to instruct or explain to the exerciser, in a simple manner, the theories of exercise concerning the target heart rate or the exercise method in each exercise mode. In addition to this use for instructions, the display-audio output processing unit 27A can also be so set as to output to the display-voice output unit 16, image data for the advertisement of a fitness club using this training machine or of a sporting goods maker, at the start, during or at the end of exercise.

After the completion of exercise, the display-audio output processing unit 27A outputs not only image data for images showing the evaluation of the exercise undertaken, the ranking of the evaluation for the exerciser, a beautiful view of an ocean or the like but also image data for a message suggesting to the exerciser to perform a slow exercise, or cooling down. Moreover, the display-audio output processing unit 27A outputs image data for images that not only give the exerciser a sense of achievement but also encourage him/her to try again next time.

In the audio output processing by the display-audio output processing unit 27A, audio data for a corresponding alarm sound is read out from the memory unit 24 and output to the speaker 18, for example, when the sensor signal detection processing unit 27B detects that the heart rate input from the sensor unit 21 has exceeded the upper limit of the reference range or that some abnormal state has developed in the load unit 13A.

The sensor signal detection processing unit 27B reads various values from signals input from the sensor signal input processing unit 21D. Also, the sensor signal detection processing unit 27B compares the read values with the values set by the setting/operating unit 22.

According to the present embodiment, the sensor signal detection processing unit 27B compares the heart rate data input from the sensor signal input processing unit 21D with the heart rate data of the last several seconds, removes noise, compares the heart rate indicated by the thus obtained heart rate data with the reference range set by the setting/operating unit 22, and outputs the result of the comparison to the display-audio output processing unit 27A. Moreover, the sensor signal detection processing unit 27B reads out the body fat value from the signal input from the sensor signal input processing unit 21D and outputs it to the display-audio output processing unit 27A. Also, the sensor signal detection processing unit 27B compares the rotating speed input from the sensor signal input processing unit 21D with the predetermined rotating speed and outputs the result of the comparison to the display-audio output processing unit 27A.

The load processing unit 27C performs the processing to output the load data, indicating the load to be generated by the load unit 13, to the load unit 13. According to the present embodiment, the load processing unit 27C receives the reference data (load reference data) corresponding to the load level set by the setting/operating unit 22 from the memory unit 24, and outputs to the load unit 13, the load data indicating the load to be generated by the load unit 13 based on the above-mentioned load reference data and the change of heart rate with time detected by the sensor signal detection processing unit 27B.

Figure 2A:
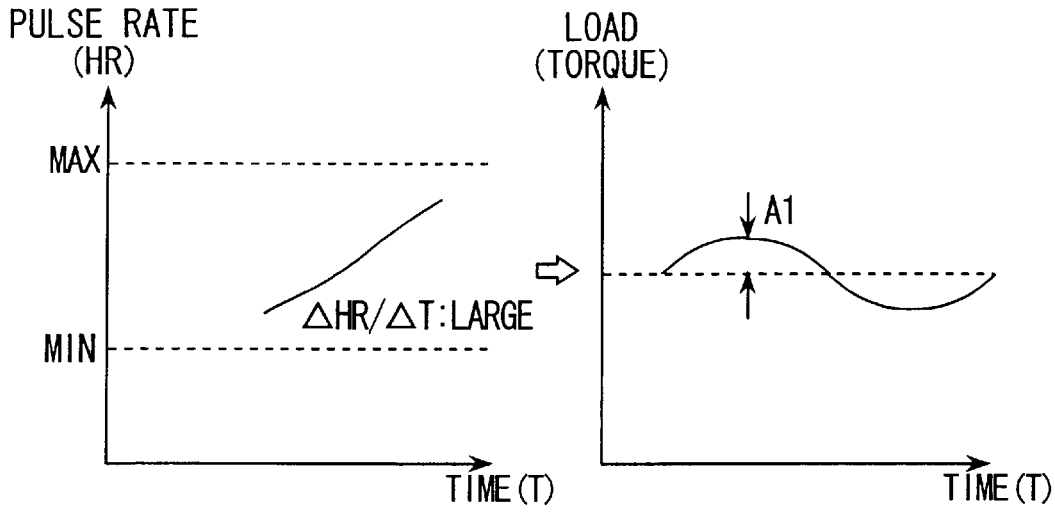
FIG. 2 explains the load data to be output by the load output processing unit of the training machine according to the first embodiment of the present invention.
Figure 2B:
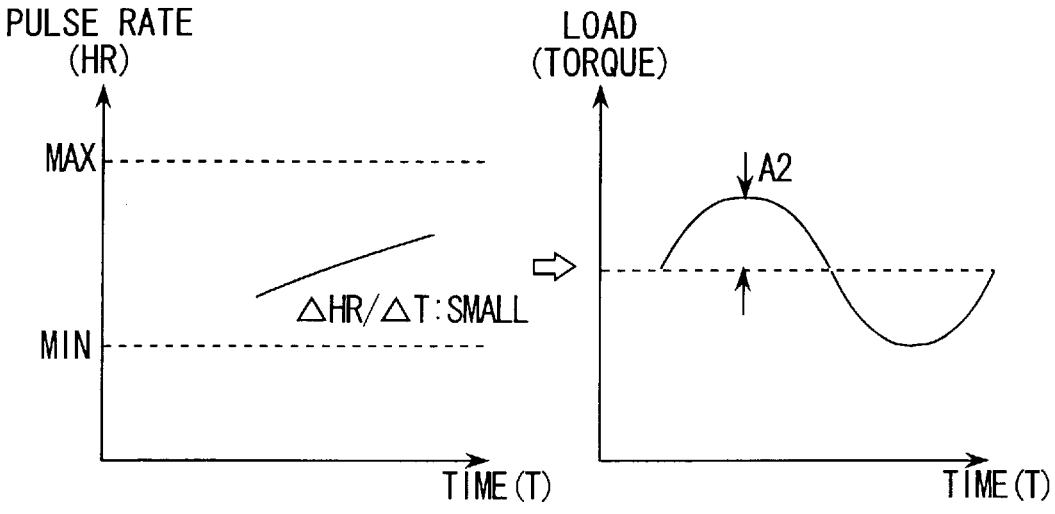

FIG. 2 is a figure explaining the load data to be output by the load processing unit 27C of the training machine according to the first embodiment of the present invention. The load processing unit 27C judges that the stamina level of the exerciser is low when, as seen in the left-hand figure of FIG. 2A, the rate of change with time ($\Delta HR/\Delta T$) of the heart rate detected by the sensor signal detection processing unit 27B is large, and then outputs a load data that makes the amplitude (A1) of the load from the load unit 13 smaller, as seen in the right-hand figure of FIG. 2A. On the other hand, the load processing unit 27C judges that the stamina level of the exerciser is high when, as seen in the left-hand figure of FIG. 2B, the rate of change with time ($\Delta HR/\Delta T$) of the heart rate detected by the sensor signal detection processing unit 27B is small and then outputs a load data that makes the amplitude (A2) of the load from the load unit 13 larger, as seen in the right-hand figure of FIG. 2B. This arrangement makes sure that proper load is given to the exerciser.

Figure 3A:
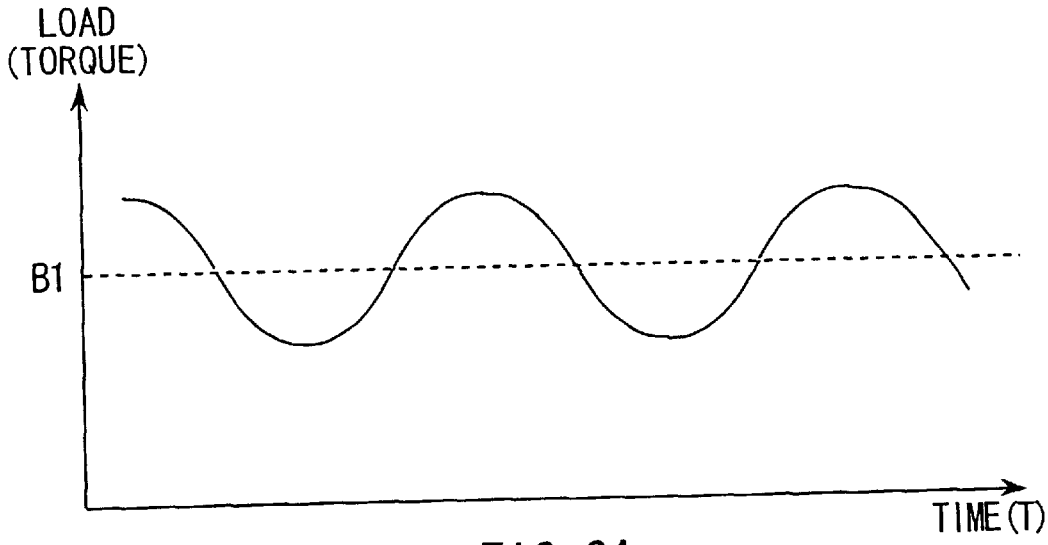
FIG. 3 also explains the load data to be output by the load output processing unit of the training machine according to the first embodiment of the present invention.
Figure 3B:
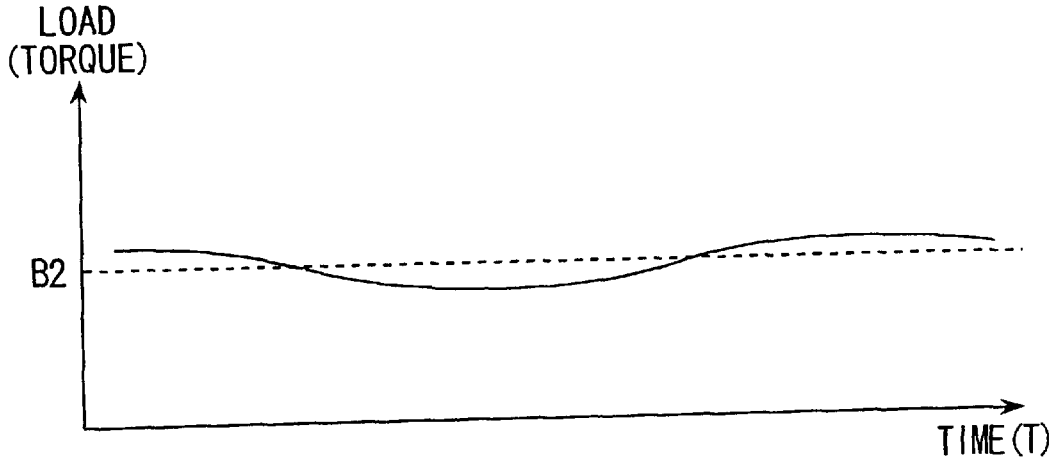

FIG. 3 is another figure which explains the load data to be output by the load processing unit 27C of the training machine according to the first embodiment of the present invention. The load processing unit 27C sees that the change in amplitude of load from the load unit 13 becomes larger when, as seen in FIG. 3A, the load reference data (B1) is high, and then outputs a load data that makes the variation with time larger. On the other hand, the load processing unit 27C sees that the change in amplitude of load from the load unit 13 becomes smaller when, as seen in FIG. 3B, the load reference data (B2) is low, and then outputs a load data that makes the variation with time smaller.

Figure 4:
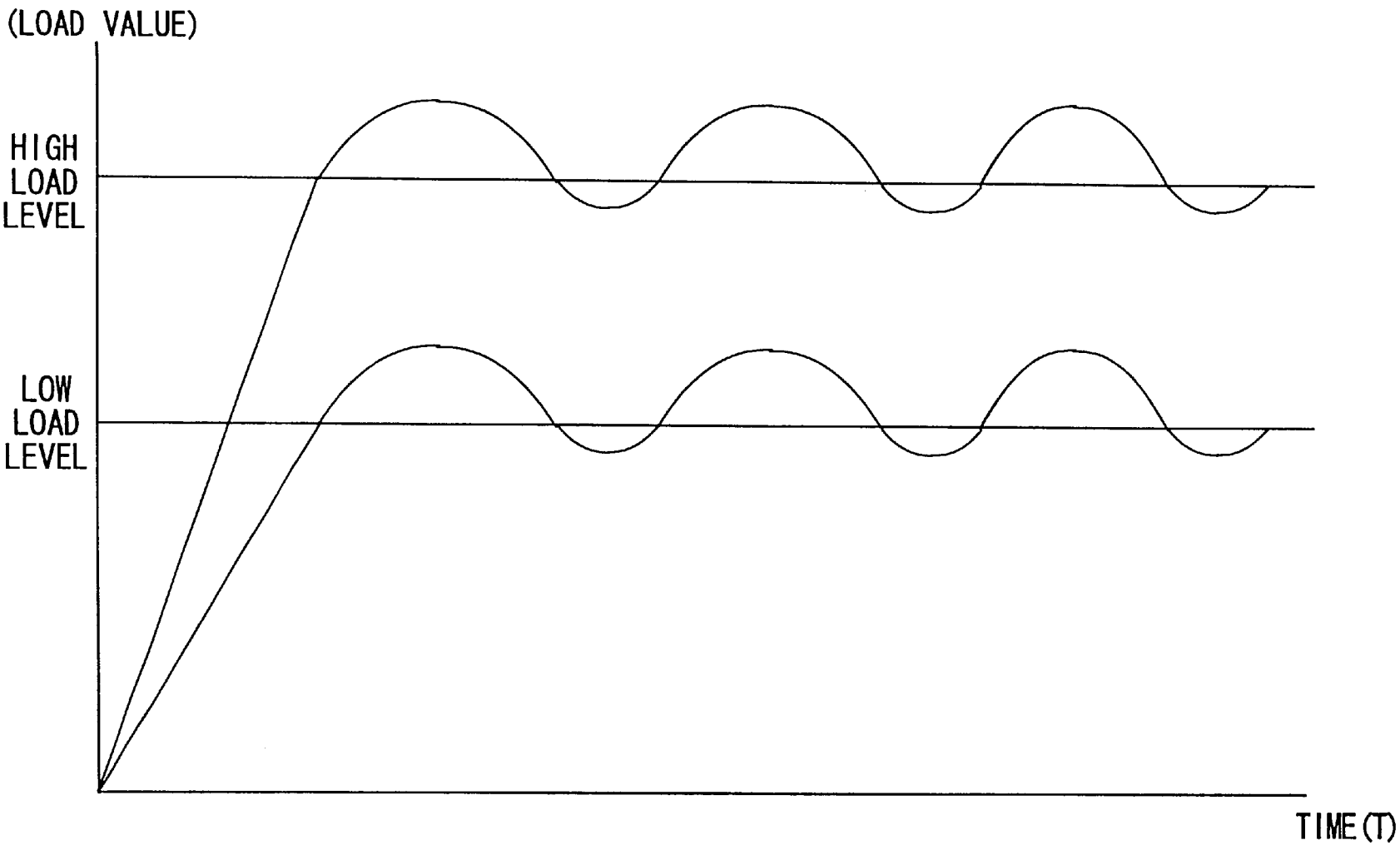
FIG. 4 explains an example of the load patterns of the load data to be output by the load output processing unit of the training machine according to the first embodiment of the present invention.

FIG. 4 is a figure explaining the load patterns of the load data to be output by the load processing unit 27C of the training machine according to the first embodiment of the present invention. FIG. 4 shows a load pattern (high load pattern) based on high load and another (low load pattern) based on low load. In each load pattern, the load value increases gradually from the start and, after it reaches the basic reference load value, keeps varying in the neighborhood of the basic load value. According to the present embodiment, the same waveform is employed for both the high load pattern and low load pattern.

The time processing unit 27D starts measuring time at a predetermined point of time and determines whether the measured time has reached the predetermined reference time (whether the time is up or not). The time processing unit 27D, for example, starts measuring time at the start of exercise and determines whether the time has reached the preset exercise time.

The database processing unit 27E manages the past and present exercise data of each exerciser related to their identification (ID) numbers via the memory unit 24, IC card or the like. The exercise data of an exerciser according to the present invention includes, for example, information based on the time in display status 2, which is a proper exercise status, the amount of exercise undertaken in display status 2, which is proper exercise status, the change in heart rate during exercise, or the total amount of exercise undertaken. Moreover, the database processing unit 27E performs statistical processing based on the information it manages. For example, the database processing unit 27E prepares image data for display images that compare the exercise data on the same exerciser at different points of time or image data for display images that compare the exercise data on different exercisers, such as ranking, and outputs them to the display-audio output processing unit 27A. It is to be noted that the statistical processing of the data managed by the database processing unit 27E can be used beneficially in product development or-marketing related hereto.

Figure 5:
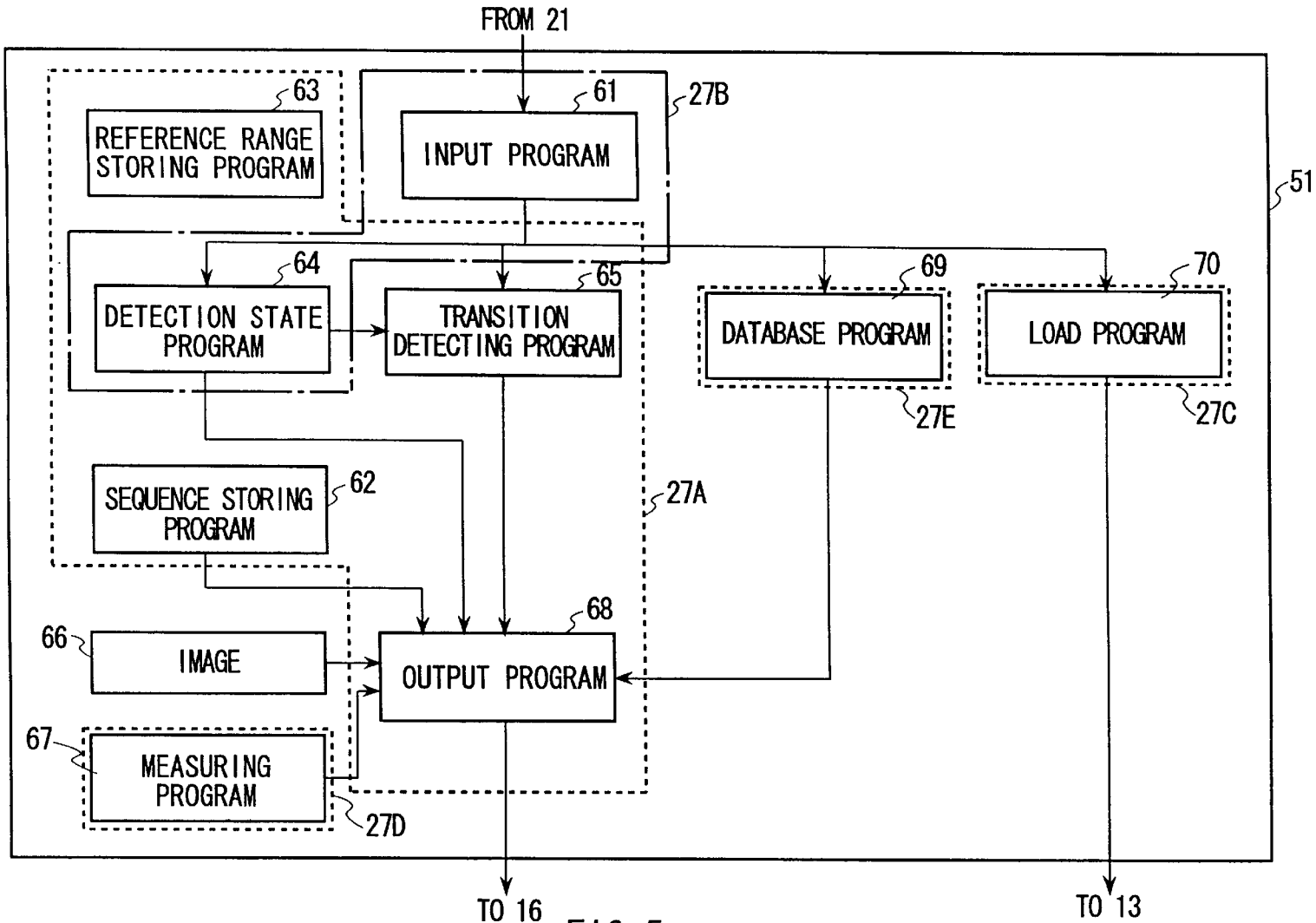
FIG. 5 is a block diagram showing an example of the configuration of an image output program according to the first embodiment of the present invention.

FIG. 5 is a block diagram showing an example of the configuration of an image output program that can realize the above-described components 27A through 27E of the data control unit 27. The image output program is read into the RAM 24B or the like of the memory unit 24 from the CD-ROM 51 or the like of the storage medium and executed by the data control unit 27. The image output program comprises an input program 61, a sequence storing program 62, a reference range storing program 63, a status detecting program 64, a transition detecting program 65, a plurality of images 66, a time measuring program 67, an output program 68, a database program 69, and a load program 70.

The input program 61 receives signals, such as the signals of heart rate, from a sensor signal input processing unit 21*e*. The sequence storing program 62 stores the sequence of display statuses. A plurality of the images 66 are the images corresponding to exercise statuses and display statuses.

The reference range storing program 63 mainly stores reference ranges or accepts the settings of reference ranges from the exercisers through the setting/operating unit 22. The status detecting program 64 mainly detects the exercise status of the exerciser, based on the heart rate received by the input program 61 and the reference range stored in the reference range storing program 63. The transition detecting program 65 mainly decides whether to effect the transition of display status or not, based on the exercise status detected by the status detecting program 64 or the signal received by the input program 61. The time measuring program 67 measures predetermined lengths of time, using a timer (not shown). Measured time is used by other programs.

The output program 68 reads out the image corresponding to the display status and outputs it to the display-voice output unit 16. For example, when the transition of display status is effected by the transition detecting program 65, the output program 68, based on the detection, reads out the image corresponding to the next display status in the sequence stored in the sequence storing program 62 and outputs it to the display-voice output unit 16. The image to be read out can be directly read from the image 66 of a storage medium, such as CD-ROM 51, or can be taken from what has already been read into a RAM 24B or the like from a storage medium, such as CD-ROM 51.

The database program 69 stores information on the exercise undertaken by the exerciser, performs the statistical processing or the like of the information on the exercise, and has the output program 69 display the results of the processing. The load program 70 generates load data and outputs them to the load unit 13.

The main functions of the programs in the present invention have been described briefly, and the above-described processing units 27A through 27E comprise the functions of these programs. In other words, the display-audio output processing unit 27A comprises the execution by the data control unit 27 of the sequence storing program 62, reference range storing program 63, status detecting program 64, transition detecting program 65, and output program 68; the sensor signal detection processing unit 27B comprises the execution by the data control unit 27 of the input program 61 and status detecting program 64; the load control unit 27C comprises the execution by the data control unit 27 of the load program 70; the time measuring unit 27D comprises the execution by the data control unit 27 of the time measuring program 67; and the database processing unit 27E comprises the execution by the data control unit 27 of the database program 69.

Referring back to FIG. 1, the IC card reader/writer 25 not only records information on the IC card but also reads information recorded on the IC card. According to the present embodiment, the IC card is given to each exerciser. On the IC card, information, such as the identification number (ID) to be used to identify the exerciser, or the owner of the IC card, the age and sex of the exerciser, and the past exercise data of the exerciser, is recorded.

The communication device 26 effects communication with external devices, such as other training machines or a host computer, via a communication line. The communication device 26 can use any communication line, which includes cable, radio and satellite communication lines. Also, the communication device 26 can output data via modem, direct bus, RS232C, PC card or the like. It is preferable that communications by the communication device 26 be established upon confirming security by the use of an individual number, such as password, machine number or identification number.

Figure 6:
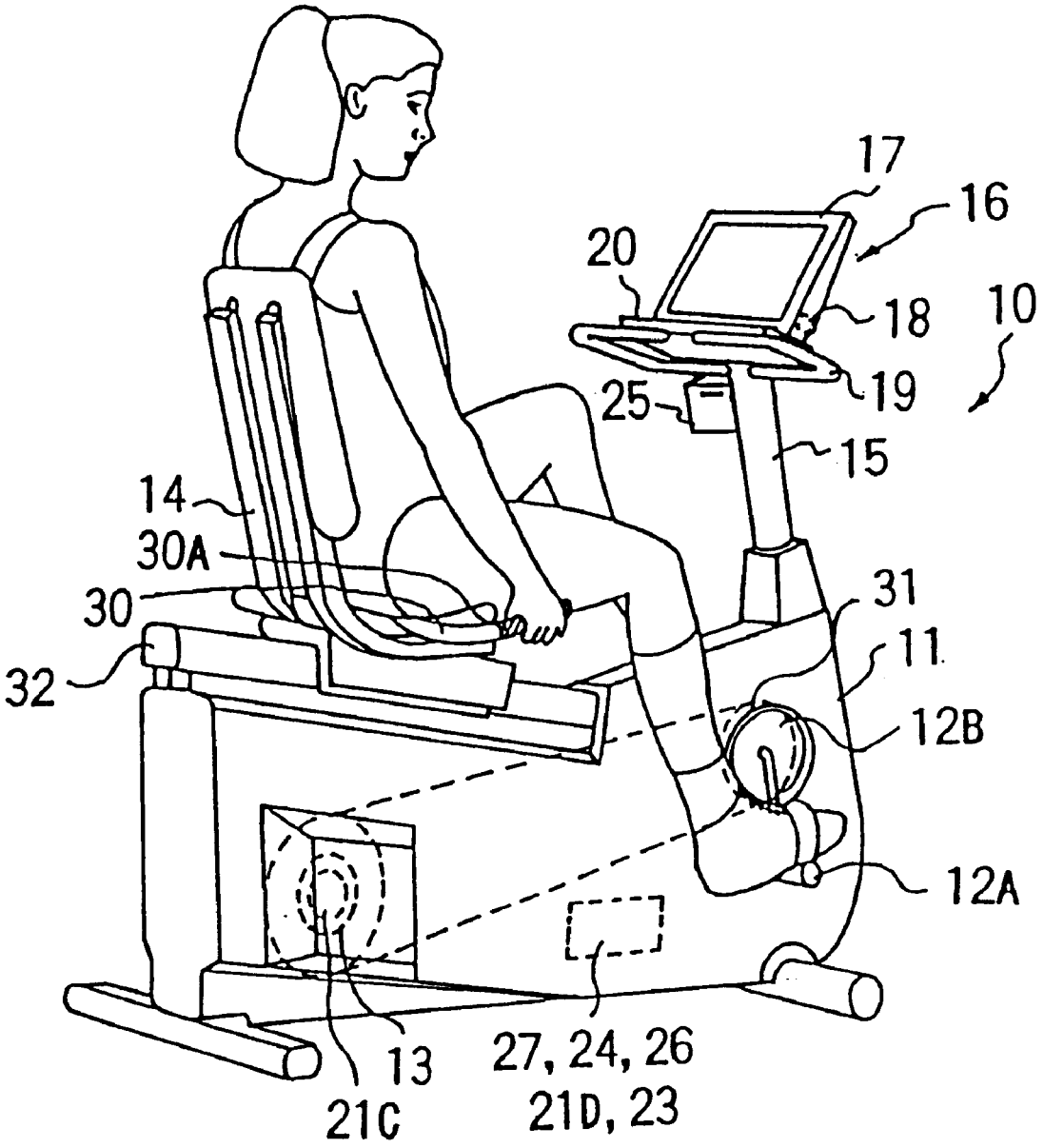
FIG. 6 shows an example of the appearance of the training machine according to the first embodiment of the present invention.

FIG. 6 shows an example of the appearance of the training machine according to the first embodiment of the present invention. The training machine 10 has a training machine body 11 formed in a box shape which is to be installed on a specified floor surface indoors. The front side (right side in the figure) of the training machine body 11 is provided with pedals 12A, similar to the ones on a bicycle, and a rotating mechanism 12B which makes the pedals 12A rotatable. The inside of the rear side of the training machine body 11 contains a load unit 13 with a rotating member which performs a prescribed rotating motion. The load unit 13 can apply a predetermined load to the rotating motion of the rotating member. The load unit 13 is provided with a rotating speed sensor 21C near the rotating member. The rotating mechanism 12B is connected to the rotating member of the load unit 13 via a belt 31, and the load applied to the rotating member by the load unit 13 is communicated to the rotation of the pedals 12A.

The front side of the training machine body 11 is also provided with a support post 15 which projects upward. Provided near the middle part of the support post 15 is an IC card reader/writer 25, and at the end thereof are a display 17 and a speaker 18, which constitute a display-voice output unit 16. Positioned on the exerciser side of the display 17 is an operating unit 20, and provided around the operating unit 20 is a handle 19 formed by a pipe frame and other parts. Because of this position of the operating unit 20, the exerciser can easily perform various operations on this unit.

Figure 7:
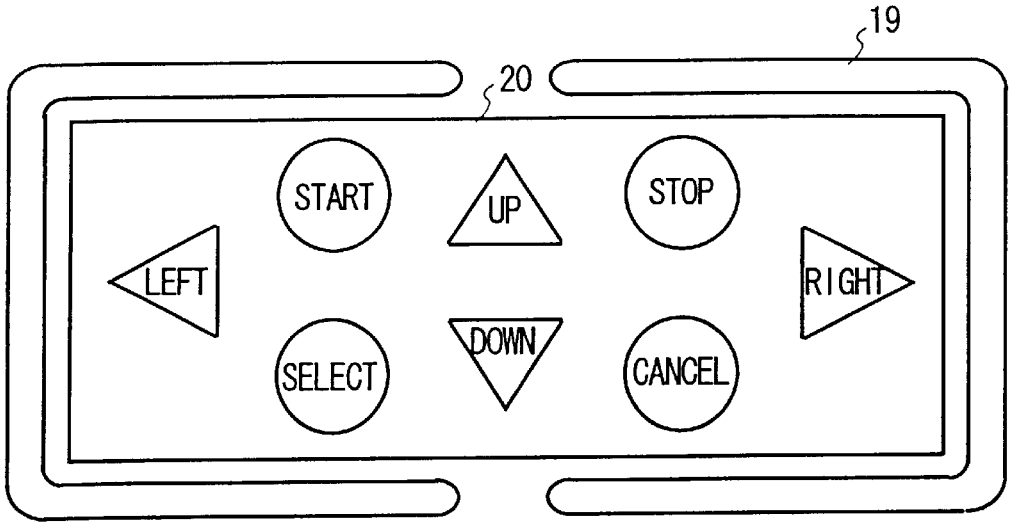
FIG. 7 is a view showing the arrangement in the close vicinity of the operating unit of the training machine according to the first embodiment of the present invention.

FIG. 7 explains the arrangement around the operating unit 20 of the training machine according to the first embodiment of the present invention. As seen in FIG. 7, the operating unit 20 is positioned right in the middle of the handle 19, and the unit is provided with the UP, DOWN, LEFT and RIGHT buttons which can move the cursor on the display screen up, down, left and right, respectively, as well as the START, STOP, SELECT and CANCEL buttons which are used to input such operating instructions.

Referring back to FIG. 6, provided inside the training machine body 11 are a sensor signal input processing unit 21D, an operating unit 23, a memory unit 24, a communication unit 26, and a data control unit 27.

Positioned above the rear side of the training machine body 11 is a seat 14. The seat 14 allows the exerciser to sit in a half-reclining position, and the exerciser can adjust the longitudinal position freely by sliding the seat along a slide rail 32.

Figure 8:
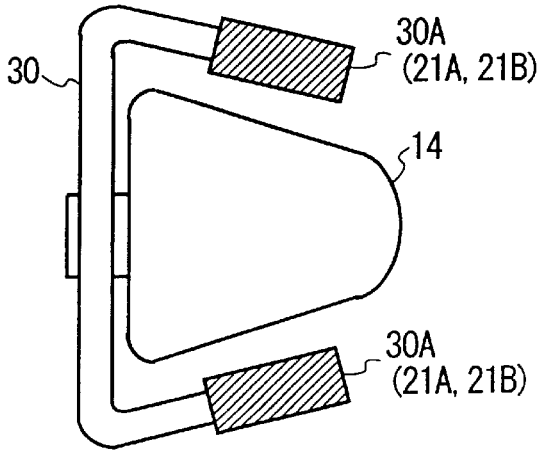
FIG. 8 is a view showing the arrangement in the close vicinity of the seat surface of the seat of the training machine according to the first embodiment of the present invention.

FIG. 8 explains the arrangement around the seat surface of the seat 14 of the training machine according to the first embodiment of the present invention. Provided around the seat surface on which the exerciser sits of the seat 14 is a pipe 30. On the portions of the pipe 30 right and left of the exerciser when he/she sits on the seat 14 are grips 30A to be held by the hands of the exerciser. Provided inside each of the right and left grips 30A are a pulse sensor 21A and a body fat sensor 21B. The pulse sensor 21A detects the heart rate through the hand of the exerciser which holds the grip 30A. For example, the body fat sensor 21B, which has an electrode in each of the right and left grips 30A of the pipe 30, measures the body fat by measuring an electric resistance resulting from weak current which flows when the hands of the exerciser come in contact with the right and left electrodes. It is also possible that both the heart rate and body fat values can be detected by electrically switching between the pulse sensor 21A and the body fat sensor 21B.

On the training machine in the present invention, the exerciser, who sits on the seat 14 in a half-reclining position, can take exercise in a generally stress-free position because his/her whole body is positioned in the rear of the pedals 12A. On this training machine, the exerciser sits on the seat 14, facing the display-voice output unit 16, holds the grips 30A or the handles 19 with the hands, and pumps the pedals 12 the same way as on a bicycle with the feet placed thereon. During the exercise, the exerciser can see the image displayed on the display 17 and hear the voice instruction output from the speaker 18.

In the above-described embodiment, the exercise unit recited in the scope of claims comprises mainly a load unit 13 and pedals 12A; the reference range storing unit, the image storing unit, the exercise data storing unit, the sequence storing unit, and the display status image storing unit recited in the scope of claims comprise mainly a memory unit 24; the status detecting unit as recited in the scope of claims comprises mainly a sensor signal detection processing unit 27B and a display-audio output processing unit 27A; the image display control unit, the display status control unit, the transition detecting unit, and the display status image display control unit recited in the scope of the claims comprise mainly a display-audio output processing unit 27A; and the extension time setting unit, the reference range setting unit, the reference time setting unit, and the exercise mode selecting unit according to what is claimed comprise mainly a setting/operating unit 22.

Also, the evaluation display control unit, the individual comparison information display control unit, and the multiple comparison display control unit according to what is claimed comprise mainly a database processing unit 27E and a display-audio output processing unit 27A; the load control unit according to what is claimed comprises mainly a load processing unit 27C and a load output processing unit 13B; the detecting unit according to what is claimed comprises mainly a sensor signal detection processing unit 27B; and the alarm output unit according to what is claimed comprises mainly a display-audio output processing unit 27A and a speaker 18.

Figure 9:
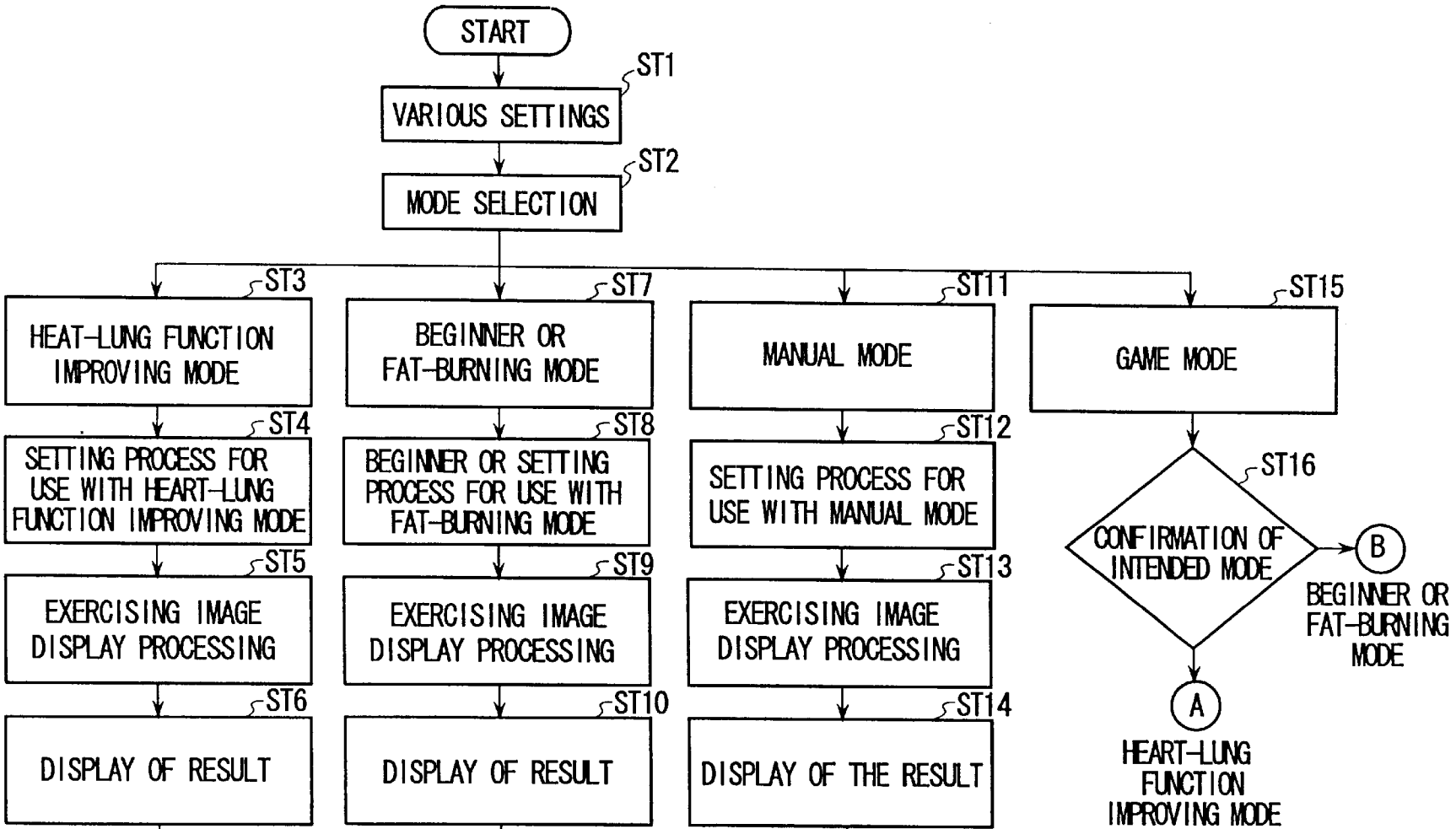
FIG. 9 is a main flowchart of the training machine according to the first embodiment of the present invention.

FIG. 9 is a main flowchart of the training machine according to the first embodiment of the present invention. Before the start of exercise on the training machine, the setting unit 23 accepts various settings (ST1). For example, the age and sex of the exerciser or the exercise time is set by the use of the buttons, keyboard, touch panel or mouse at the setting unit 23. It is also possible that the above-mentioned setting can be performed by reading the information on the age, sex or the like stored on the IC card inserted in the IC card reader/writer 25.

Then the display-audio output processing unit 27A outputs an image including buttons showing a plurality of exercise modes to the display 17 and accepts the selection of exercise mode by the cursor key and buttons on the operating unit 20 (ST2). According to the present embodiment, one of the four exercise modes, namely, the heart-lung function improving mode, the beginner or fat-burning mode, the manual mode and the game mode, can be selected.

When the heart-lung function improving mode is selected (ST3), the setting process for the heart-lung function improving mode is carried out (ST4). In this process, the display-audio output processing unit 27A reads out from the memory unit 24, the predetermined exercise time, load level, reference range (e.g., upper limit value and lower limit value) of heart rate during exercise and the like corresponding to the heart-lung function improving mode and causes the display-voice output unit 16 to display them. Then the operating unit 20 accepts the approval of the displayed setting or the change thereto from the exerciser. Then the image display process during exercise is carried out according to the information set as described above (ST5), and after the end of the exercise, the exercise data display process for the exerciser is carried out (ST6).

Also, when the beginner or fat-burning mode is selected (ST7), the setting process for the beginner or fat-burning mode is carried out (ST8). In this process, the display-audio output processing unit 27A reads out from the memory unit 24, the predetermined exercise time, load level, reference range (e.g., upper limit value and lower limit value) of heart rate during exercise and the like corresponding to the beginner or fat-burning mode and causes the display-voice output unit 16 to display them. Then the operating unit 20 accepts the approval of the displayed setting or the change thereto from the exerciser. Then the image display process during exercise is carried out according to the information set as described above (ST9), and after the end of the exercise, the exercise data display process for the exerciser is carried out (ST10).

Also, when the manual mode is selected (ST11), the setting process for the manual mode is carried out (ST12). In this process, the display-audio output processing unit 27A causes the display-voice output unit 16 to display the input screen for various information to be set, such as the exercise time, load level, and reference range (e.g., upper limit value and lower limit value) of heart rate during exercise, and the operating unit 20 accepts settings from the exerciser. These settings can be freely changed by the operating unit 20 during exercise. Then the image display process during exercise is carried out according to the information set as described above (ST13), and after the end of the exercise, the exercise data display process for the exerciser is carried out (ST14).

Also, when the game mode is selected (ST15), the input process for the intended exercise in the game mode is carried out (ST16) According to the present embodiment, the operating unit 20 accepts the input which selects either the heart-lung function improving mode or the beginner or fat-burning mode. When the heart-lung function improving mode is input (A), the same process as for the heart-lung function improving mode (ST4 to ST6) is carried out. On the other hand, when the beginner or fat-burning mode is input (B), the same process as for the beginner or fat-burning mode (ST8 to ST10) is carried out. When the game mode is selected, however, random factors are introduced in various settings, such as that of fish type.

Figure 10:
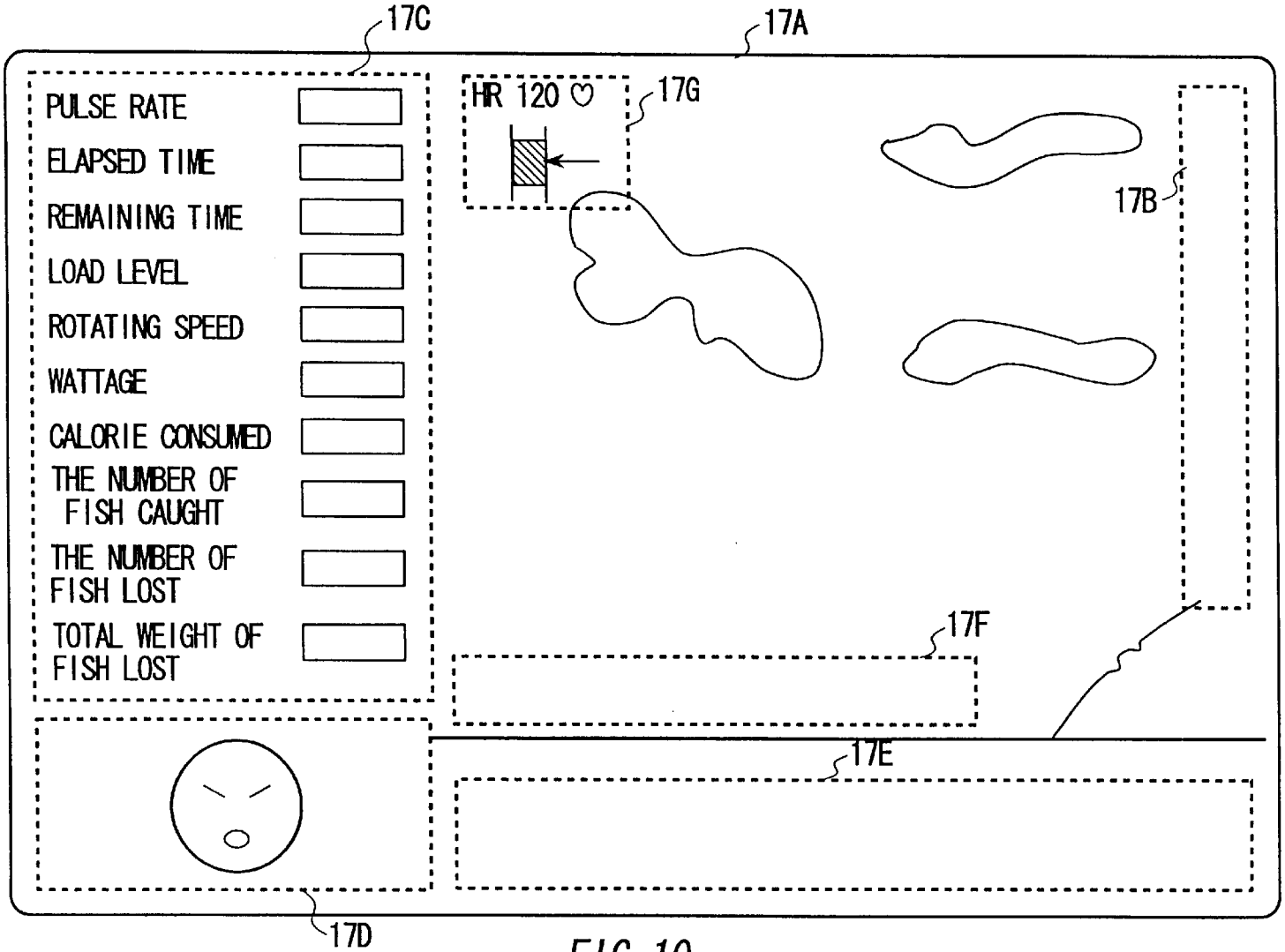
FIG. 10 shows the arrangement of the screen displayed on the display unit of the training machine according to the first embodiment of the present invention.

FIG. 10 shows the arrangement of the screen displayed on the display 17 by the display-audio output processing unit 27A mainly during exercise of the training machine according to the first embodiment of the present invention. The display screen of the display 17 comprises an image display area 17A, nearly in the center of the screen, which displays the images of trolling during exercise and the images of the ocean, clouds, etc., during cooling-down, after the end of exercise; a distance display area 17B, in the narrow area on the right-hand corner of the screen, which displays an indicator that shows the distance or the like to the fish being caught in trolling; a data display area 17C, in the upper left position of the screen, which displays the information of the exercise undertaken by the exerciser; a screen display area 17D, in the lower left position of the screen, which displays at predetermined timings the characters appearing in the trolling, such as the expressions of the captain; a character display area 17E, near the lower middle position of the screen, which displays various messages to the exerciser; an alarm display area 17F which displays alarm messages to the exerciser; and a heart rate information display area 17G which displays the present heart rate of the exerciser relative to the reference range (e.g., upper and lower limits) of the heart rate thereof.

The information on the exercise undertaken to be displayed in the data display area 17C includes, as seen in the figure, the heart rate, elapsed time, remaining time, load level, rotating speed, wattage, calories consumed, number of fish caught, number of fish lost, and total weight of fish lost. The mode of display of these items of information in the data display area 17C can be digital in which the values are displayed directly, or analog in which the data can be displayed in bar graphs or the like. The exercise data and display mode for the data display area 17C can be selected using the SELECT button on the operating unit 20 during exercise or after the end of exercise. Also, whether to display the data display area 17C or not can be selected on the operating unit 20.

Figure 11:
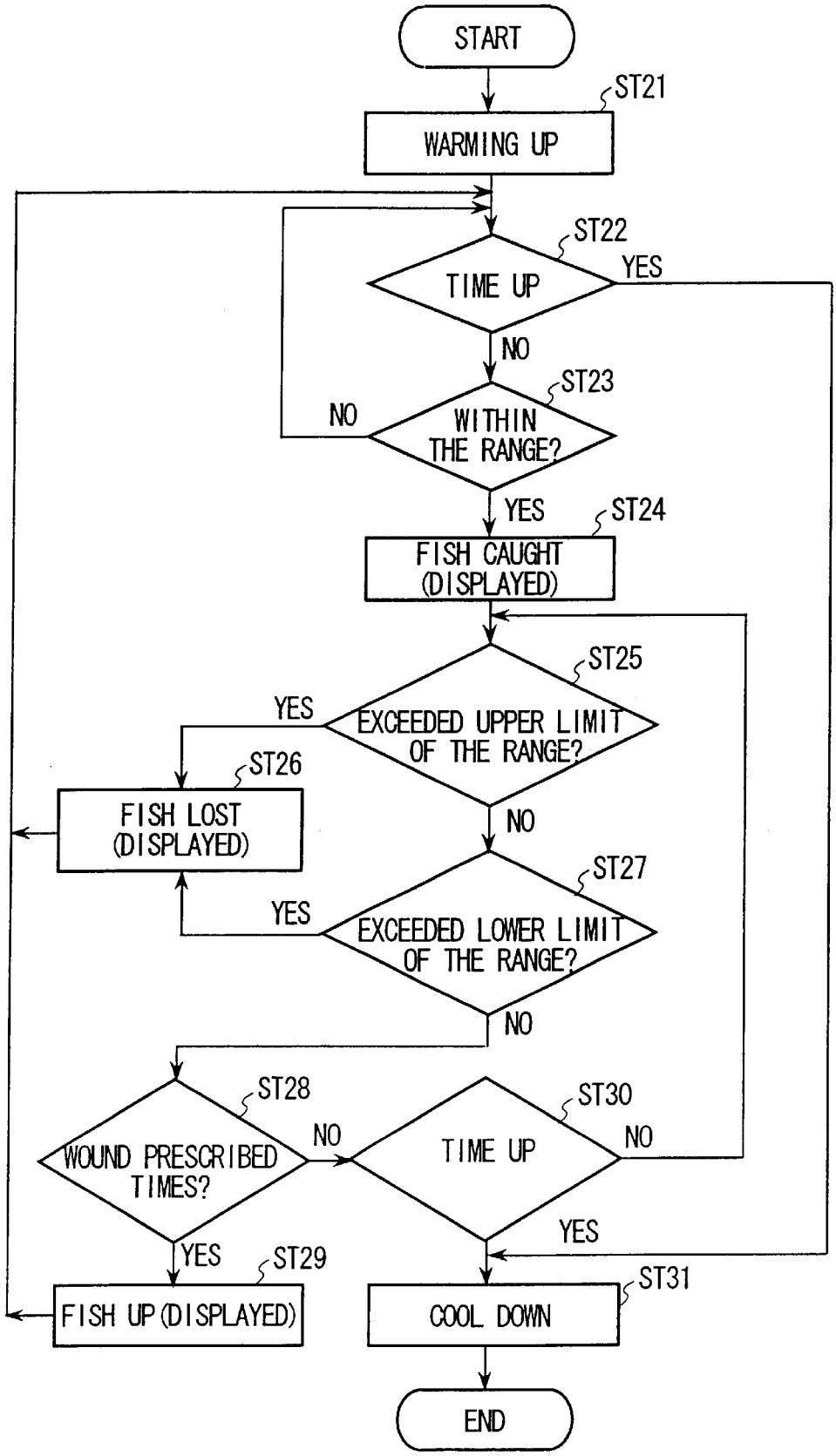
FIG. 11 is a flowchart explaining the image display processing during exercise by the training machine according to the first embodiment of the present invention.

FIG. 11 is a flowchart explaining the image display processing during exercise (ST5, ST9, ST13 in FIG. 8) of the training machine according to the first embodiment of the present invention. When the exerciser on the training machine completes a warming-up prior to training and starts training (ST21), the time processing unit 27D starts measuring the time from the start of training. The start of training can be set by the instruction of the exerciser through the operating unit 20 or by the measurement of predetermined time for warming-up, by the time processing unit 27D.

Then the time processing unit 27D detects whether the time from the start of training has exceeded the predetermined exercise time (the time is up) or not (ST22), and when it has not exceeded it, the sensor signal detection processing unit 27B detects whether the heart rate detected by the heart rate sensor 21A is within the reference range or not (ST23). As a result, when it is detected that the heart rate detected by the heart rate sensor 21A is within the reference range, the display-audio output processing unit 27A causes the time processing unit 27D to measure the predetermined time from the above-mentioned point in time, and detects whether the detection continues that the heart rate from the sensor signal detection processing unit 27B remains within the reference range during the above-mentioned time. As a result, when it keeps receiving the detection result that the heart rate remains within the reference range, the display-audio output processing unit 27A, judging that the exerciser is now in a proper exercise status, shifts the display status of the exerciser to display status 2, which is the display status after display status 1, meaning a proper exercise status, reads out the image data corresponding to the above-described display status 2 from the memory unit 24 and outputs to the display 17 of the display-voice output unit 16, and the display 17 displays the image corresponding to the display status 2 (ST24)

Figure 12A:
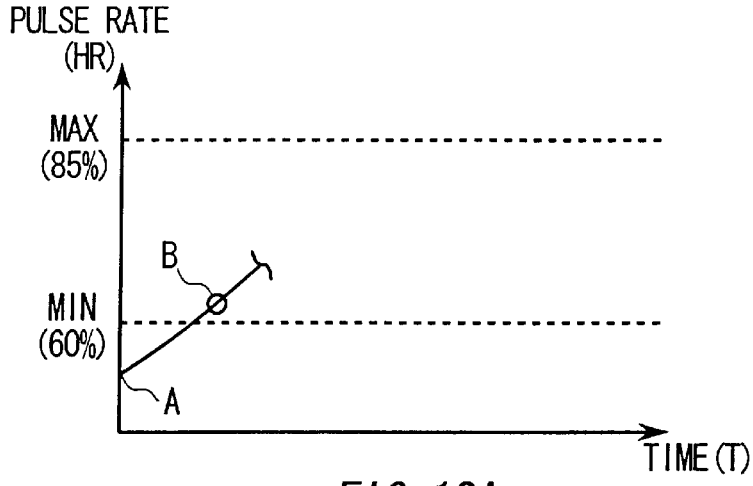
FIG. 12 shows an example of the change in the heart rate of the exerciser detected by the heart rate sensor of the training machine according to the first embodiment of the present invention.

FIG. 12A shows an example of the change in the heart rate of the exerciser detected by the heart rate sensor 21A. This figure represents the case where the exercise mode selected is the heart-lung function improving mode, that is, the reference range is set for 60 to 85 percent of the maximum heat rate. As seen in the figure, if the above-described processing is carried out, the heart rate rises gradually from the start point A of exercise and at point B, or a preset time past the lower limit of the reference range, or 60 percent of the maximum heart rate, the image corresponding to display status 2, which means a proper exercise status, is displayed by the display 17.

Figure 13:
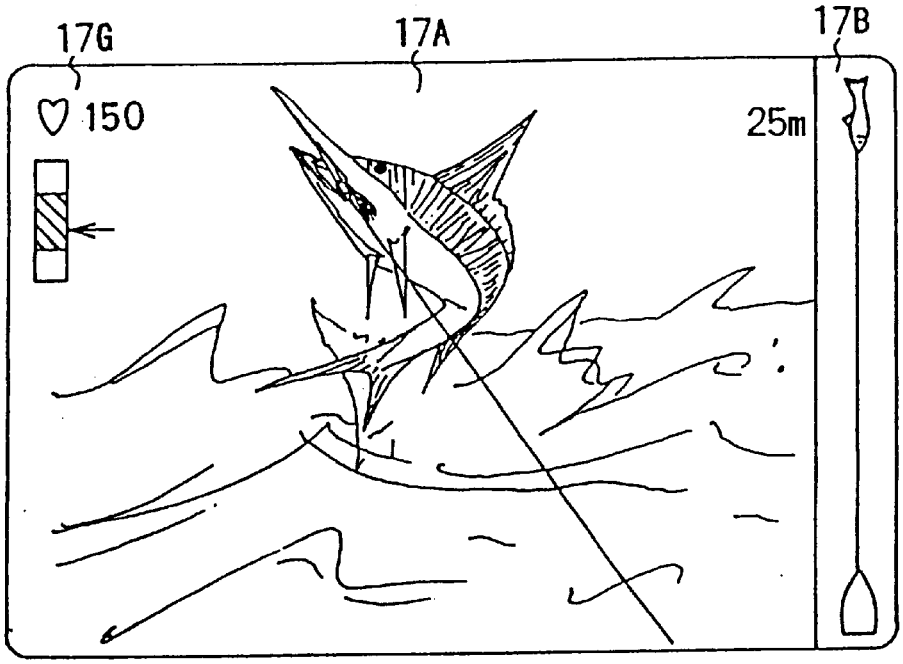
FIG. 13 shows an example of the display screen displaying the image corresponding to display state 2, which means a proper state in the training machine according to the first embodiment of the present invention.

FIG. 13 shows an example of the display screen on the display 17 displaying the image corresponding to display status 2, which means a proper exercise status, of the training machine according to the first embodiment of the present invention. As seen in FIG. 13, the image display area 17A in the display screen of the display 17 displays stereoscopically a realistic image of a blue marlin caught on the line jumping above the water, as the image corresponding to display status 2. The distance display area 17B displays a figure showing the distance to the fish together with a numerical value showing the distance (25M in the figure). Moreover, the heart rate information display area 17G displays the heart rate (150 in the figure), a heart mark indicating the heart rate, a bar graph-like figure showing the reference range within the possible heart rate range, and an arrow indicating the position of the current heart rate on the figure.

The exerciser can see his/her own heart rate at that moment in relation to the reference range, by looking at the heart rate information display area 17G. Also, by looking at the image display area 17A, the exerciser can confirm that he/she is in a proper exercise status, the image reviving his/her interest in the exercise. Also, by checking the distance display area 17B, the exerciser can see when the fish will be landed by the pumping of the pedals 12 at the current rate, that is, when his/her relatively short-term target can be accomplished. This further stimulates his/her interest in the exercise.

Then, the sensor signal detection processing unit 27B detects whether the heart rate detected by the heart rate sensor 21A has exceeded the upper limit of the reference range (ST25) or the lower limit thereof (ST27). As a result, when the heart rate has exceeded the upper limit or the lower limit of the reference range, the sensor signal detection processing unit 27B causes the time processing unit 27D to measure a preset length of time from this point of time, and detects whether the detection result that the heart rate belongs in the reference range comes from the sensor signal detection processing unit 27B in the preset length of time. As a result, when the detection result that the heart rate belongs in the reference range does not come in the preset length of time, the display-audio output processing unit 27A, judging that the exerciser is now in an improper exercise status, which is hazardous for the exerciser or producing no beneficial effects of exercise, shifts the display status of the exerciser to display status 3 or display status 4, which is the display status after display status 2, meaning an improper exercise status, reads out the image data showing the above-described display status 3 or 4 from the memory unit 24 and outputs it to the display-voice output unit 16 (ST26).

Figure 12B:
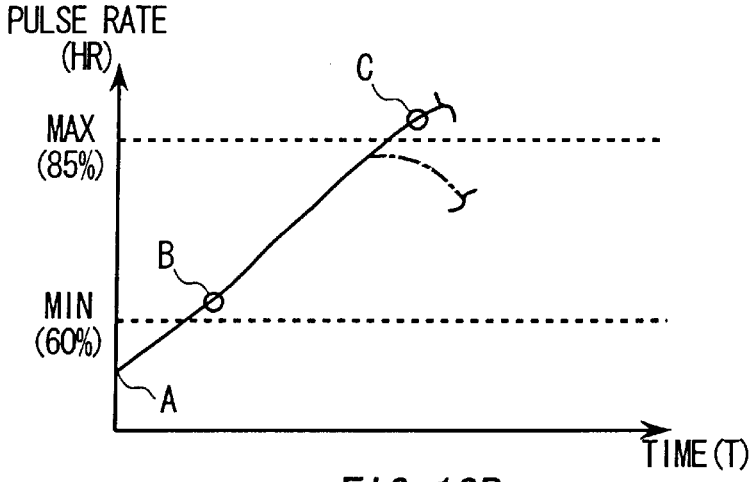
Figure 12C:
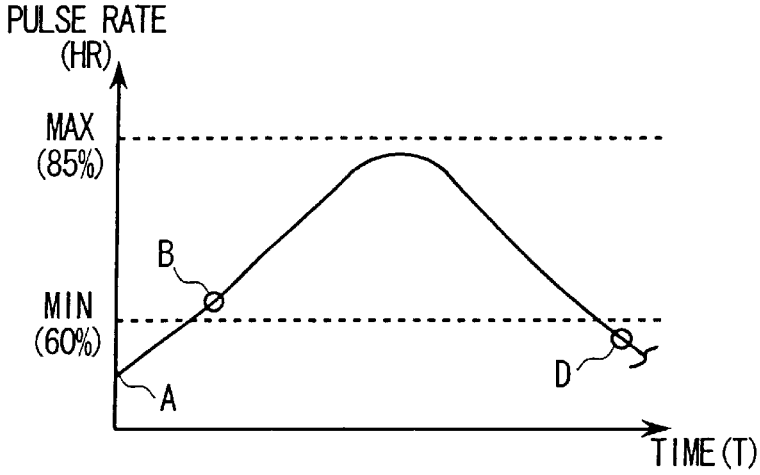

FIG. 12B and FIG. 12C show examples of the change in the heart rate of the exerciser detected by the heart rate sensor 21A. This figure represents the case where the exercise mode selected is the heart-lung function improving mode that is, the reference range is set for 60 to 85 percent of the maximum heat rate. As seen in FIG. 12B, if the heart rate rises further from point B and reaches point C above the upper limit of the reference range, the image corresponding to display status 3 will be displayed by the display 17. On the other hand, as seen in FIG. 12C, if the heart rate drops from point B and reaches point D below the lower limit of the reference range, the image corresponding to display status 4 will be displayed by the display 17.

Figure 14:
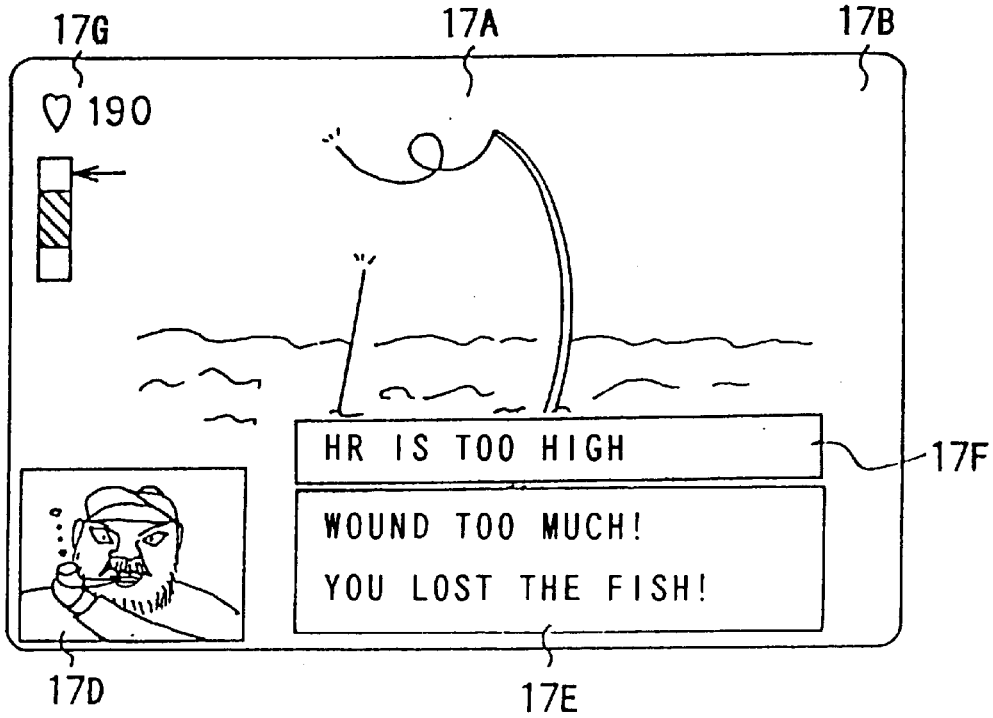
FIG. 14 shows an example of the display screen displaying the image corresponding to display state 4, which means an improper state in the training machine according to the first embodiment of the present invention.

FIG. 14 shows an example of the display screen on the display 17 displaying the image corresponding to display status 3, which means an improper exercise status, of the training machine according to the first embodiment of the present invention. As seen in FIG. 14, the image display area 17A in the display screen of the display 17 displays an image of a fish lost, with the line snapping, as the image corresponding to display status 3. The distance display area 17B no longer displays a figure showing the distance to the fish. The heart rate information display area 17G displays 190 as the heart rate and an arrow indicating the present heart rate in the position above the upper limit of the reference range of the bar graph-like figure showing the reference range. Also, the screen display area 17D displays the captain advising the exerciser, and the display area 17E displays "WOUND TOO MUCH" as the words spoken by the captain. Also, the alarm display area 17F displays a message "HR IS TOO HIGH."

The exerciser can see his/her own heart rate at that moment in relation to the reference range, by looking at the heart rate information display area 17G. Also, by looking at the image display area 17A, the exerciser can confirm that he/she is in an improper exercise status. Also, by checking the display area 17E, the exerciser can learn his/her exercise status at that moment.

Figure 15:
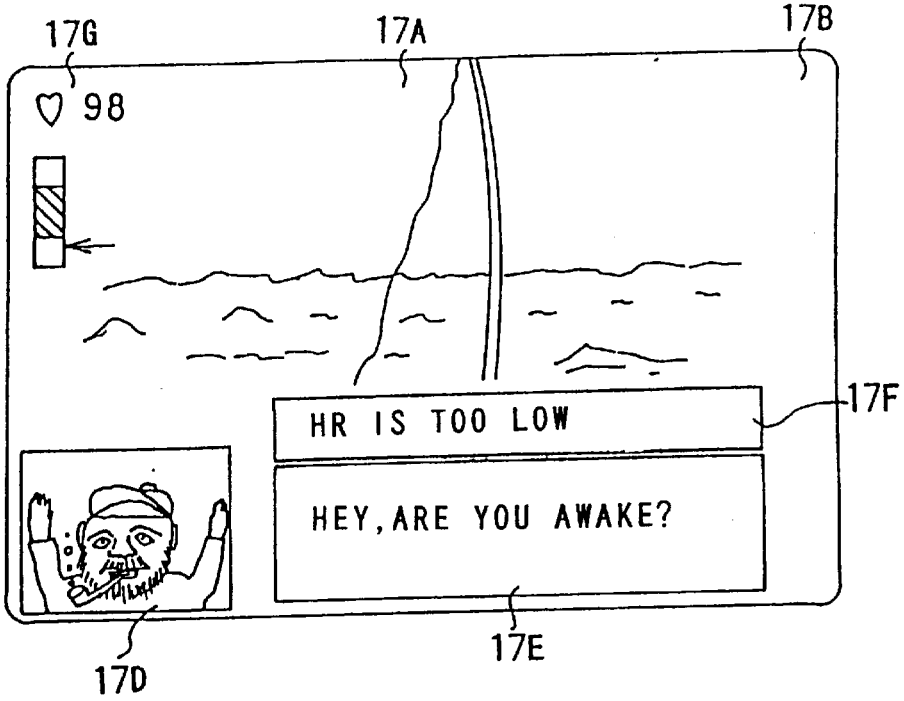
FIG. 15 shows an example of the display screen displaying the image corresponding to display state 3, which means an improper state in the training machine according to the first embodiment of the present invention.

FIG. 15 shows an example of the display screen on the display 17 displaying the image corresponding to display status 4, which means an improper exercise status, of the training machine according to the first embodiment of the present invention. As seen in FIG. 15, the image display area 17A in the display screen of the display 17 displays an image of a fish lost after being unhooked, as the image corresponding to display status 4. The distance display area 17B no longer displays a figure showing the distance to the fish. The heart rate information display area 17G displays 98 as the heart rate and an arrow indicating the present heart rate in the position below the lower limit of the reference range of the bar graph-like figure showing the reference range. Moreover, the screen display area 17D displays the captain advising the exerciser, and the display area 17B displays "HEY, ARE YOU AWAKE?" and "YOU LOST THE FISH" as the words spoken by the captain. Also, the alarm display area 17F displays a message "HR IS TOO LOW."

The exerciser can see his/her own heart rate at that moment in relation to the reference range, by looking at the heart rate information display area 17G. Also, by looking at the image display area 17A, the exerciser can confirm that he/she is in an improper exercise status. Also, by checking the display area 17E or the alarm display area 17F, the exerciser can learn his/her exercise status at that moment.

On the other hand, when the sensor signal detection processing unit 27B detects that the heart rate detected by the heart rate sensor 21A is within the reference range, the sensor signal detection processing unit 27B detects whether the number of revolutions detected by the rotating speed sensor 21C has reached the predetermined number of revolutions (ST28). As a result, when it has not reached the predetermined number of revolutions, the display-audio output processing unit 27A reads out the image showing display status 2, meaning a proper exercise status, which is the image, based on the total number of revolutions, after the start of display status 2 input from the sensor signal detection processing unit 27B, that is, the image data showing an approaching fish, from the memory unit 24 and outputs it to the display-voice output unit 16. Moreover, the display-audio output processing unit 27A displays a fishing rod bent in proportion to the amount of exercise undertaken by the exerciser in the image display area 17A of the display 17. Then the time processing unit 27D detects whether the time from the start of training has reached the preset exercise time or not (ST30), and if it has not reached the preset exercise time, the above-described processes (ST25 through 28) are carried out.

On the other hand, when the number of revolutions detected by the rotating speed sensor 21C has reached the predetermined number of revolutions, the display-audio output processing unit 27A, judging that the exerciser is in a proper exercise status and the purpose for the present has been achieved, shifts the display status of the exerciser to display status 5, which is the display status after display status 2, and outputs the image data for the image of a fish landed, or fished up, which corresponds to display status 5, and outputs it to the display-voice output unit 16 (ST29).

Figure 16:
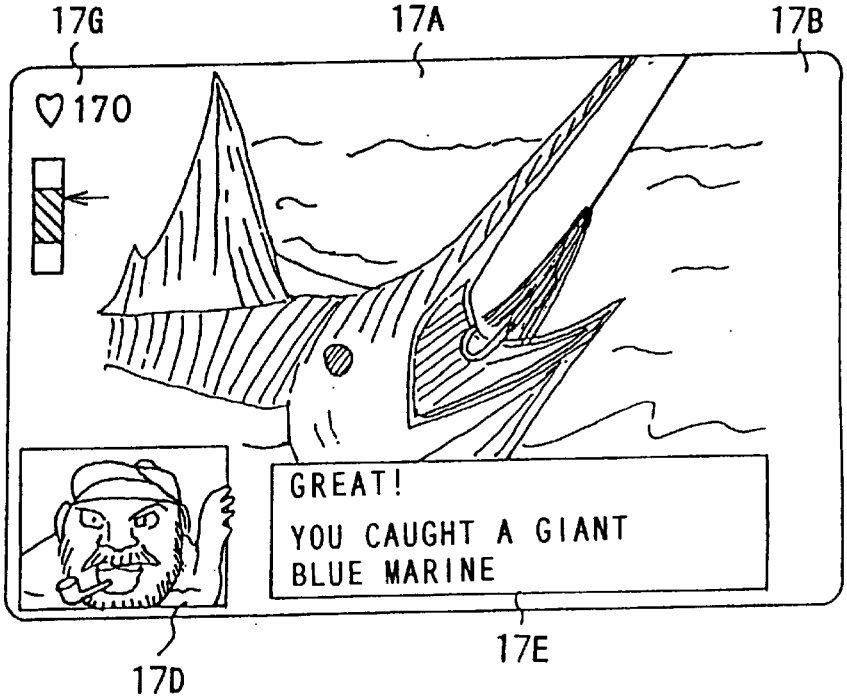
FIG. 16 shows an example of the display screen displaying the image corresponding to display state 5, which means an improper state and the intended purpose has been achieved in the training, machine according to the first embodiment of the present invention.

FIG. 16 shows an example of the display screen on the display 17 displaying the image corresponding to display status 5, which means the exerciser is in a proper exercise status and the intended purpose has been achieved, of the training machine according to the first embodiment of the present invention. As seen in FIG. 16, the image display area 17A in the display screen of the display 17 displays an image of a landed blue marlin as the image corresponding to display status 5. The distance display area 17B no longer displays a figure showing the distance to the fish. Also, the heart rate information display area 17G displays the heart rate and an arrow indicating the present heart rate at the bar graph-like figure showing the reference range. The screen display area 17D displays the captain advising the exerciser, and the display area 17E displays "GREAT! YOU CAUGHT A GIANT BLUE MARLIN" as the words spoken by the captain. The exerciser can gain a sense of accomplishment by looking at the image display area 17A. This further stimulates his/her interest in the exercise.

When the time processing unit 27D determines that the time is up (ST22,30), the exerciser is instructed to perform cooling-down (ST31). At this time, the display-audio output processing unit 27A instructs the exerciser to exercise slowly by causing the display-voice output unit 16 to display an image of a beautiful ocean or the like encouraging the use of the training machine again. During this time or after this, the display-audio output processing unit 27A also causes the display-voice output unit 16 to display the evaluation results of the exercise undertaken, such as the number of fish landed or the amount of exercise undertaken.

Also, during any of the above-described processes, when the display-audio output processing unit 27A detects that the change in heart rate detected by the sensor signal detection processing unit 27B is smaller than the designated lower limit of permissible change or larger than the designated upper limit thereof while the load from the load unit 13A is changing, an image, voice message or the like warning that the exerciser can be in an abnormal physical condition is output to the display-voice output unit 16. According to the present embodiment, a warning message is displayed in the alarm display area 17F as seen in FIG. 10.

This way, the exerciser can acquire a correct grasp of his/her own heart rate and the heart rate at that moment in relation to the reference range. Moreover, the exerciser can easily see if he/she is in a proper or improper exercise status. Also, the images, which change according to the physical information on the exerciser, can stimulate the interest of the exerciser in the training.

Furthermore, as described above, the display status changes in a preset sequence and images are displayed in correspondence to the display status, so that images in a series of a story can be offered to the exerciser, thus stimulating the interest of the exerciser. Moreover, there are parts where a display status branches out into a plurality of display statuses, so that a variety of story lines can be offered to the exerciser, thus further stimulating the interest of the exerciser.

The present invention of the training machine will now be described in terms of a second preferred embodiment thereof. The training machine according to the second embodiment is basically of the same configuration as the training machine according to the first embodiment shown in FIG. 1 and FIG. 8. Therefore, the following description mainly covers the component features that differ.

The memory unit 24 stores additionally the direction of change in heart rate, the difference from the limit value of the reference range, and the corresponding messages to be output.

Figure 17:
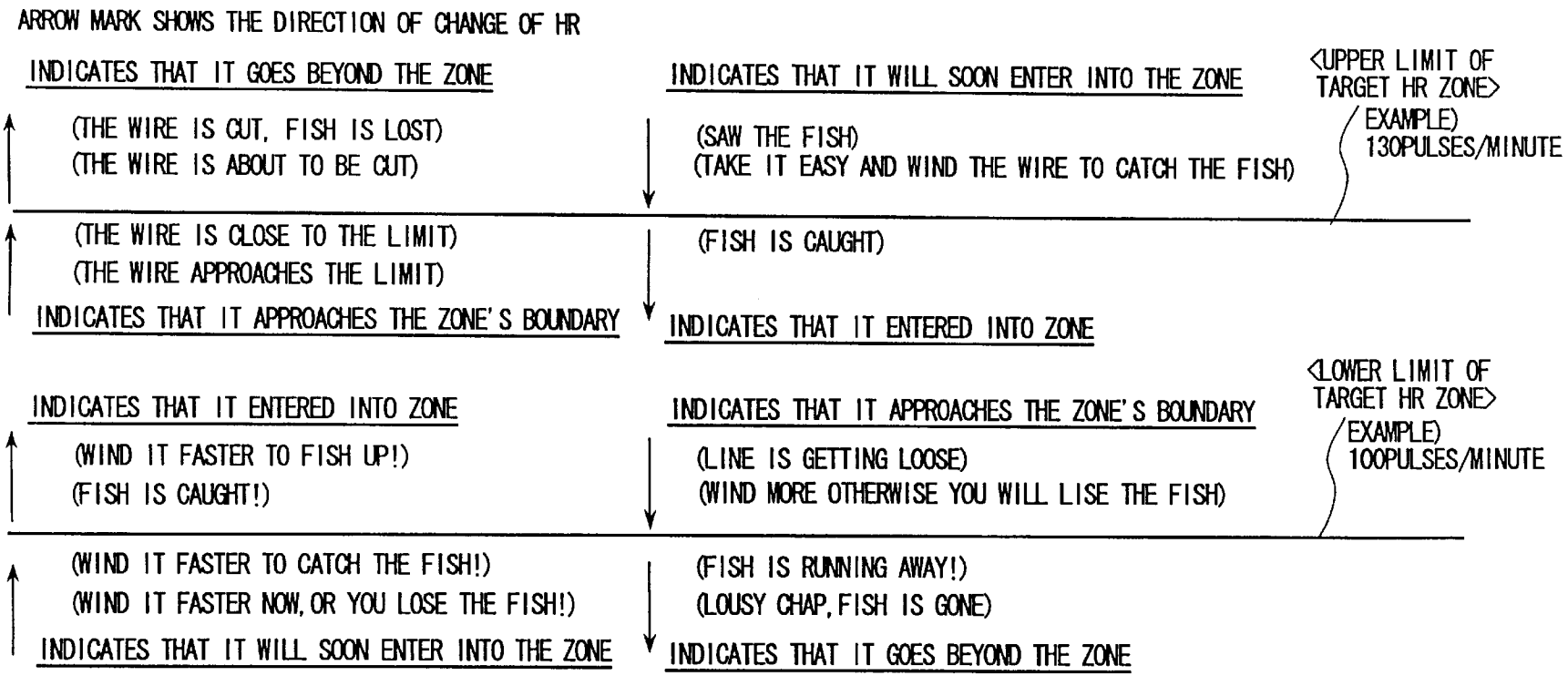
FIG. 17 shows an example of the message stored in the memory unit in the training machine according to the second embodiment of the present invention.

FIG. 17 shows an example of the messages stored in the memory unit 24 of the training machine according to the second embodiment of the present invention. As seen in FIG. 17, the memory unit 24 has memories of "THE LINE APPROACHES THE LIMIT" as the message to be displayed when the increasing heart rate reaches the preset difference with the upper limit of the reference range, "THE LINE IS CLOSE TO THE LIMIT" as the message to be displayed when the difference with the upper limit of the reference range becomes smaller, "THE LINE IS ABOUT TO SNAP" as the message to be displayed when the heart rate has exceeded the upper limit of the reference range, and "THE LINE IS CUT, FISH IS LOST" as the message to be displayed when the display status has become display status 4.

Moreover, the memory unit 24 has memories of "WIND IT FASTER TO CATCH THE FISH" as the message to be displayed when the increasing heart rate reaches the preset difference with the lower limit of the reference range, "WIND FASTER, THE FISH IS ABOUT TO BITE" as the message to be displayed when the difference with the lower limit of the reference range becomes smaller, "FISH IS CAUGHT" as the message to be displayed when the heart rate has entered display status 2, and "WIND IT FASTER TO FISH UP" as the message to be displayed when the heart rate has entered the reference range and the difference with the lower limit thereof has become the preset difference.

Moreover, the memory unit 24 has memories of "I SAW THE FISH" as the message to be displayed when the decreasing heart rate reaches the preset difference with the upper limit of the reference range, "TAKE IT EASY AND WIND THE LINE TO CATCH THE FISH" as the message to be displayed when the difference with the upper limit of the reference range becomes smaller, "FISH IS CAUGHT" as the message to be displayed when the display status has become display status 2.

Moreover, the memory unit 24 has memories of "LINE IS SLACK" as the message to bed is played when the decreasing heart rate reaches the preset difference with the lower limit of the reference range, "WIND FASTER, OR YOU'LL LOSE THE FISH" as the message to be displayed when the difference with the lower limit of the reference range becomes smaller, "FISH IS GETTING AWAY" as the message to be displayed when the heart rate has gone below the lower limit of the reference range, and "LOUSY CHAP, FISH IS GONE" as the message to be displayed when the heart rate has entered display status 3.

Moreover, the memory unit 24 stores a load table containing a plurality of load data which shows the load to be generated by the load unit 13A. The load table is managed, for example, in correspondence to the exercise mode. The load data can be set on the setting unit 23. It is preferable that a plurality of patterns of load table be prepared for each exercise mode. Furthermore, the memory unit 24 stores the reference ranges for different points of time during the exercise time.

Figure 18:
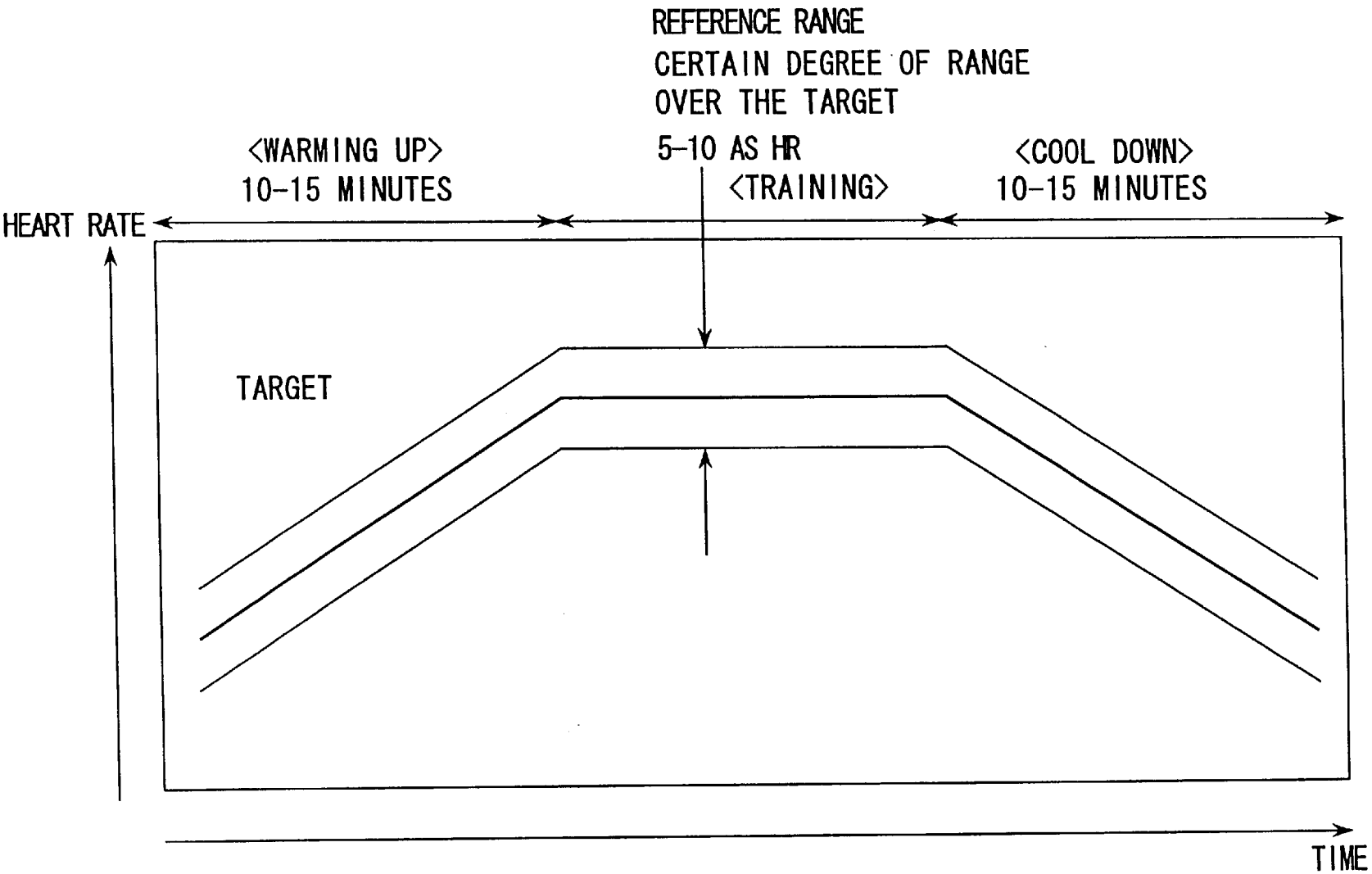
FIG. 18 shows an example of the reference range stored in the memory unit in the training machine according to the second embodiment of the present invention.

FIG. 18 shows an example of the reference ranges stored in the memory unit 24 of the training machine according to the second embodiment of the present invention. The memory unit 24 stores the reference ranges which shift the target heart rate gradually upward during the warming-up period, maintain a constant range of heart rate during the training period, and shift the heart rate gradually downward during the cooling-down period as shown in FIG. 18, by storing the target heart rate and the tolerance width for the target (e.g., 5 to 10 of heart rate) for each point in time during the warming-up, training and cooling-down periods.

Figure 19:
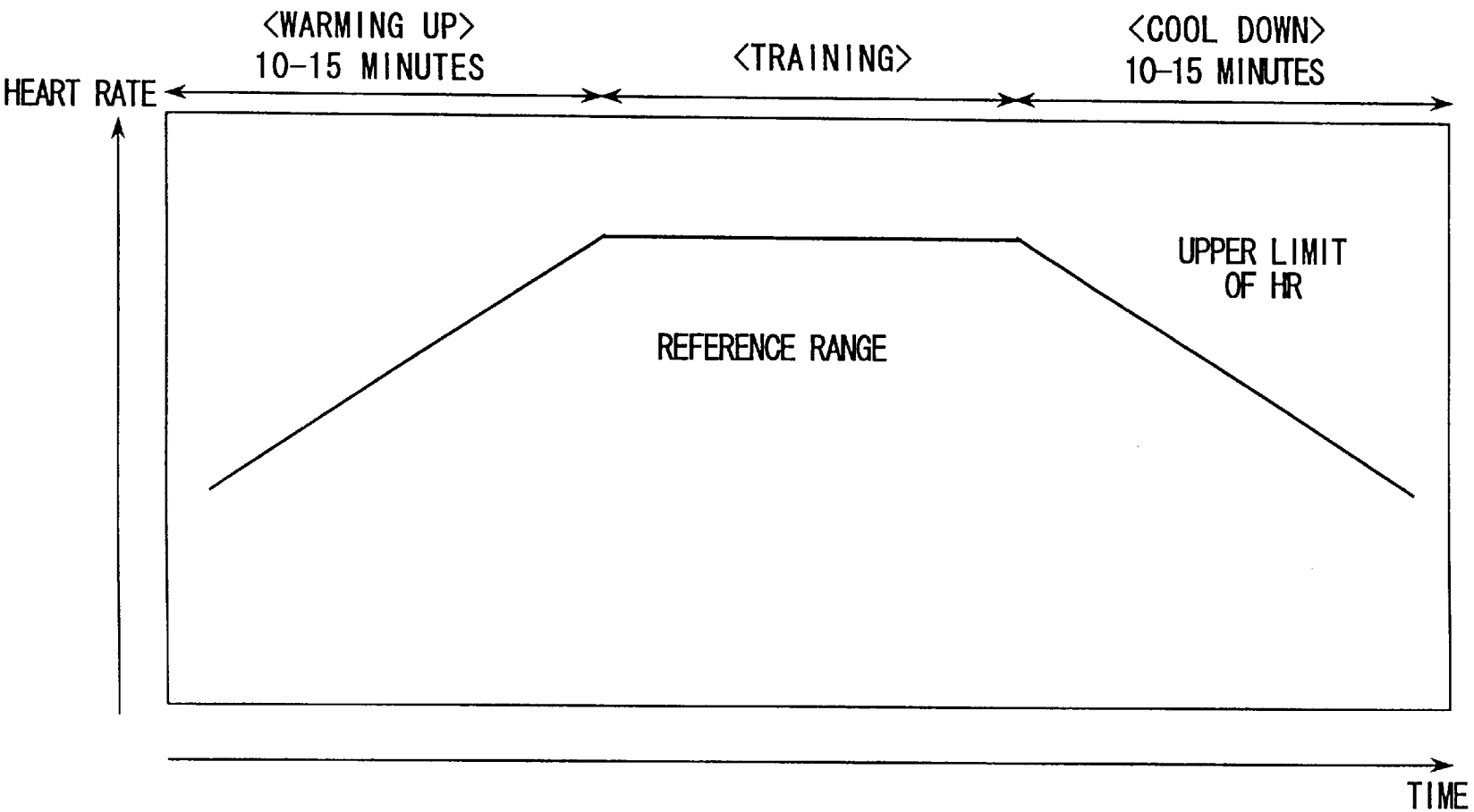
FIG. 19 shows another example of the reference range stored in the memory unit in the training machine according to the second embodiment of the present invention.

FIG. 19 shows another example of the reference ranges stored in the memory unit 24 of the training machine according to the second embodiment of the present invention. The memory unit 24 stores, for example, the reference ranges which shift the upper limit gradually in the direction of a higher heart rate during the warming-up period, maintain a constant upper limit of heart rate during the training period, and shift the upper limit gradually in the direction of a lower heart rate during the cooling-down period as shown in FIG. 19, by storing the upper limit heart rates for each point in time during the warming-up, training and cooling-down periods.

Figures 20A, 20B, 20C:
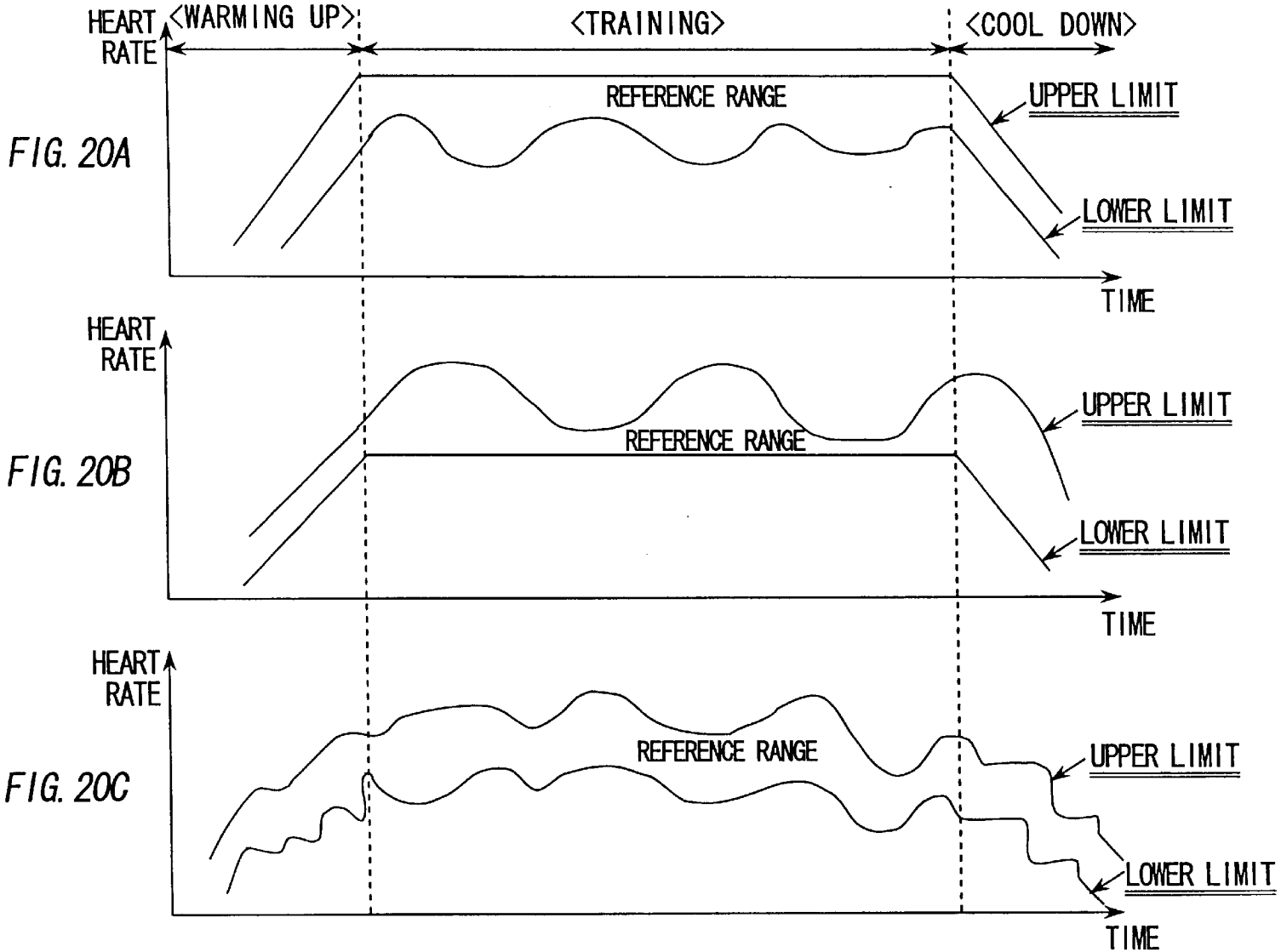
FIG. 20 shows still another example of the reference range stored in the memory unit in the training machine according to the second embodiment of the present invention.

FIG. 20 shows another example of the reference ranges stored in the memory unit 24 of the training machine according to the second embodiment of the present invention. As seen in FIG. 20A, the reference ranges to be stored in the memory unit 24 can be such that the upper limit is increased gradually during the warming-up period, is maintained constant during the training period, and is decreased gradually during the cooling-down period, while the lower limit is fluctuated during the training period. Moreover, as seen in FIG. 20B, the reference ranges to be stored in the memory unit 24 can be such that the upper limit is fluctuated during the training period. Moreover, as seen in FIG. 20C, the reference ranges to be stored in the memory unit 24 can be such that the upper limit and the lower limit are fluctuated from the end of the warming-up period to provide an interval training for the exerciser. As information which specifies such reference ranges, the upper limit and lower limit values for each point in time can be stored, or the cycle (frequency) of fluctuation of the upper limit or the lower limit, the reference heart rate for the fluctuation, the width of fluctuation and the like can be stored.

It is preferred that, according to Maffeton's theory, the reference ranges to be stored in the memory unit 24 are such that the warming-up period is 10 to 15 minutes, the cooling-down period is 10 to 15 minutes, and the upper limit of the reference range during the training period is equal or close to the value of 180 minus the age of the exerciser. Information necessary for the setting of the reference ranges to be stored in the memory unit 24, such as the warming-up time, training time, cooling-down time, and reference ranges for each point of time, can be set by the exerciser or the owner of the training machine via the setting/operating unit 22.

The time processing unit 27D further includes a beyond-the-limits timer which measures the time from the point where the sensor signal detection processing unit 27B detects that the heart rate is outside the reference range, and a within-the-limits timer which measures the time from the point where the sensor signal detection processing unit 27B detects that the heart rate is within the reference range.

The sensor signal detection processing unit 27B further detects the direct-on of change of the heart rate detected by the sensor unit 21 and the difference of the heart rate with the boundary value of the reference range (upper limit and lower limit in the present embodiment) and outputs them to the display-audio output processing unit 27A.

The display-audio output processing unit 27A judges that the exerciser is in an improper exercise status when the sensor signal detection processing unit 27B does not provide a detection result that the heart rate belongs in the reference range, before the time measured by the beyond-the-limits timer of the time processing unit 27D exceeds the predetermined extension time. The above-described extension time can be set on the setting/operating unit 22. Moreover, the display-audio output processing unit 27A judges that the exerciser is in a proper exercise status when the sensor signal detection processing unit 27B keeps providing the detection result that the heart rate belongs in the reference range, before the time measured by the within-the-limits timer of the time processing unit 27D exceeds the predetermined extension time. The above-described extension time can be set on the setting/operating unit 22.

The display-audio output processing unit 27A, when the memory unit 24 has the message corresponding to the direction of change of the heart rate and the difference of the heart rate with the boundary value input from the sensor signal detection processing unit 27B, reads out the message from the memory unit 24 and outputs it to the display-voice output unit 16.

Moreover, the display-audio output processing unit 27A displays the image which shows the relationship between the heart rate from the preset point of time (e.g., the starting point of exercise) till the present, input from the sensor signal detection processing unit 27B and the preset reference range.

Figure 21:
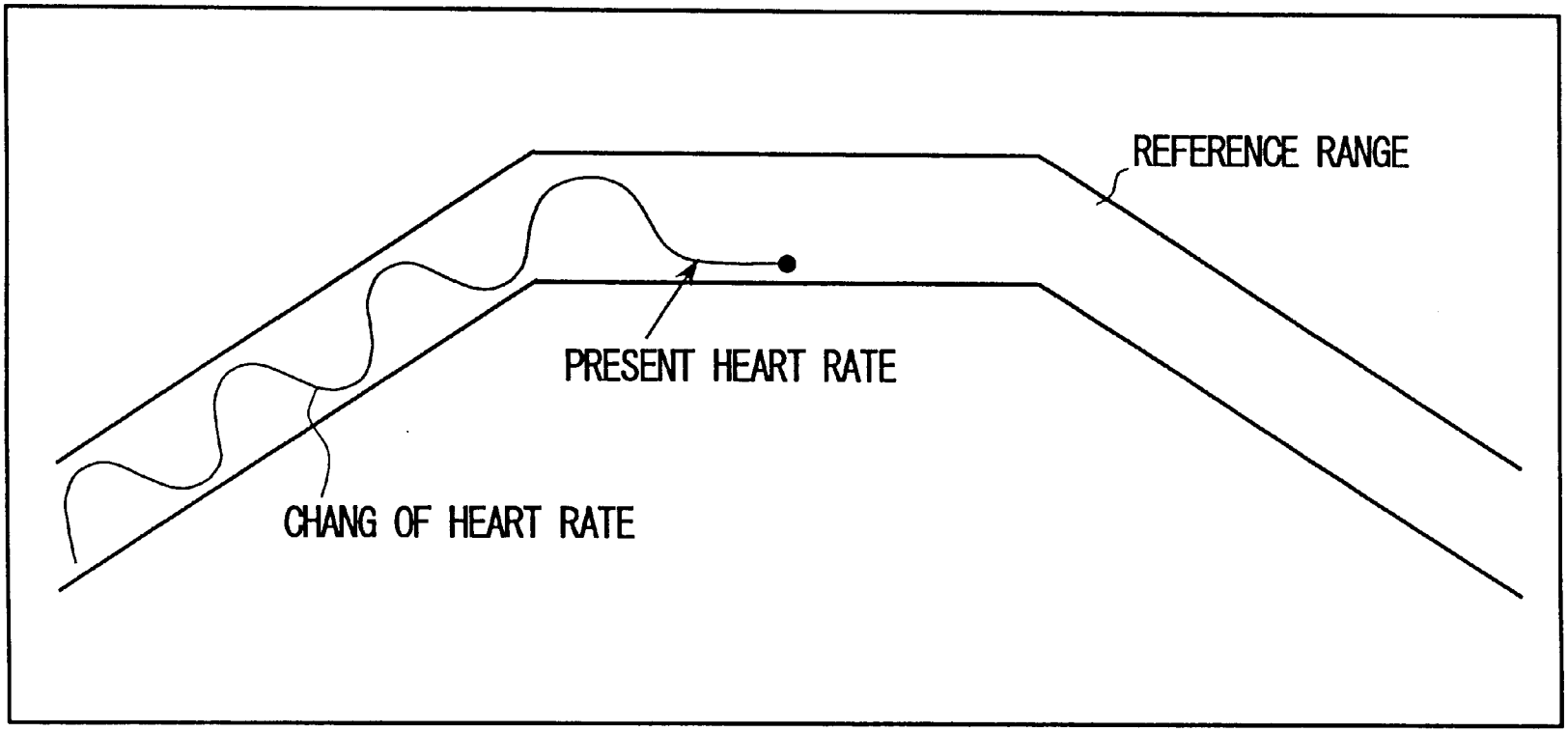
FIG. 21 is an example of display of the display unit of the raining machine according to the second embodiment of the present invention.

FIG. 21 shows an example of the image showing the relationship between the heart rate from the start of exercise till the present, and the reference range on the display 17 of the training machine according to the second embodiment of the present invention. It is a graphic representation of the change with time of the information displayed in the heart rate information display area 17G shown in FIG. 10. The image shows the preset reference range during the exercise time and the change of the heart rate of the exerciser, overlapping with each other. By checking this image, the exerciser can easily and correctly grasp the relationship between his/her own heart rate and the reference range.

In the second embodiment of the present invention, the perceptual information output unit according to what is claimed comprises mainly a display-voice output unit 16 and a display-audio output processing unit 27A, and the reference load value storing unit according to what is claimed comprises mainly a memory unit 24.

Figure 22:
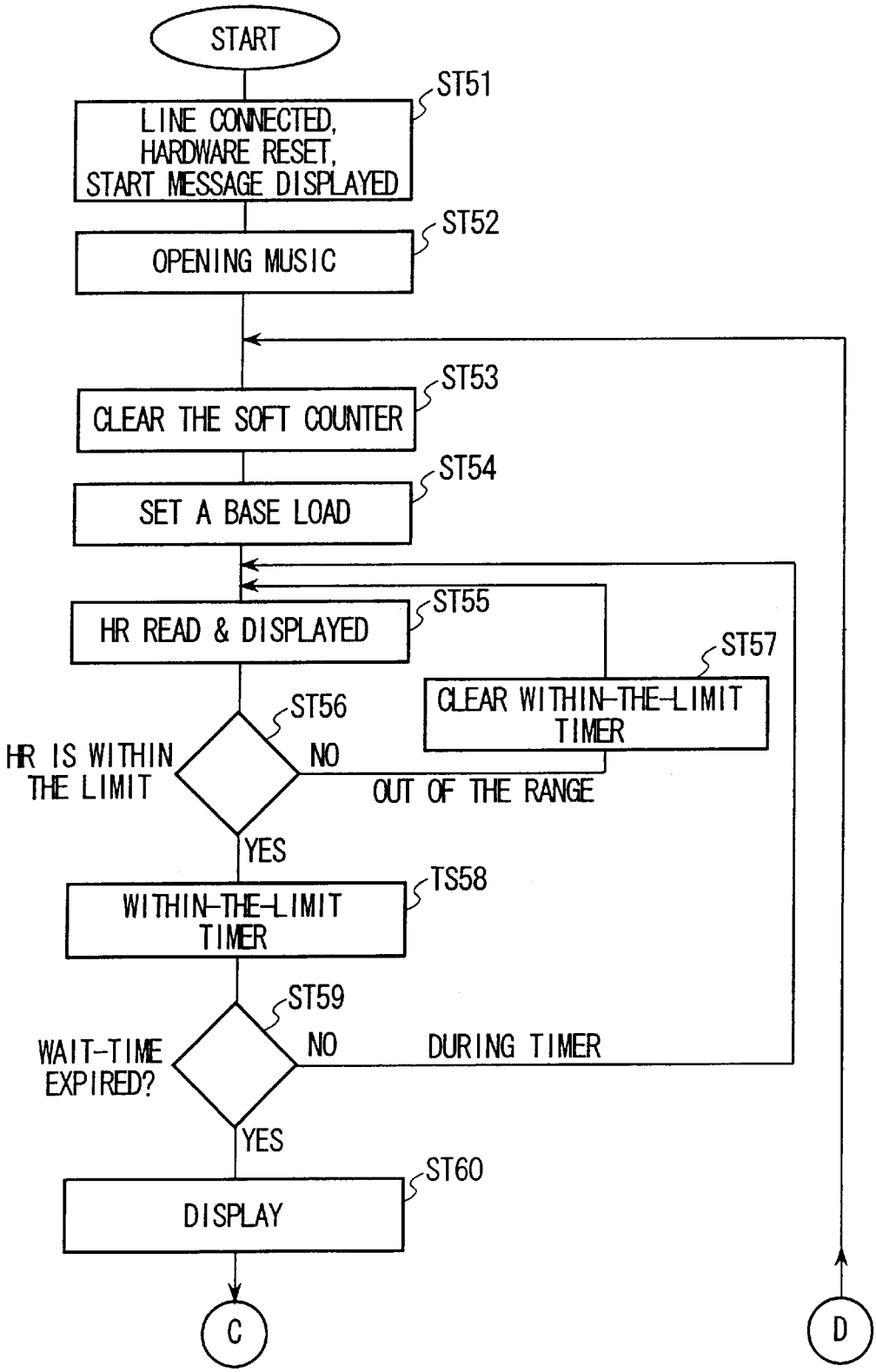
FIG. 22 is a flow chart of the training machine according to the second embodiment of the present invention.
Figure 23:
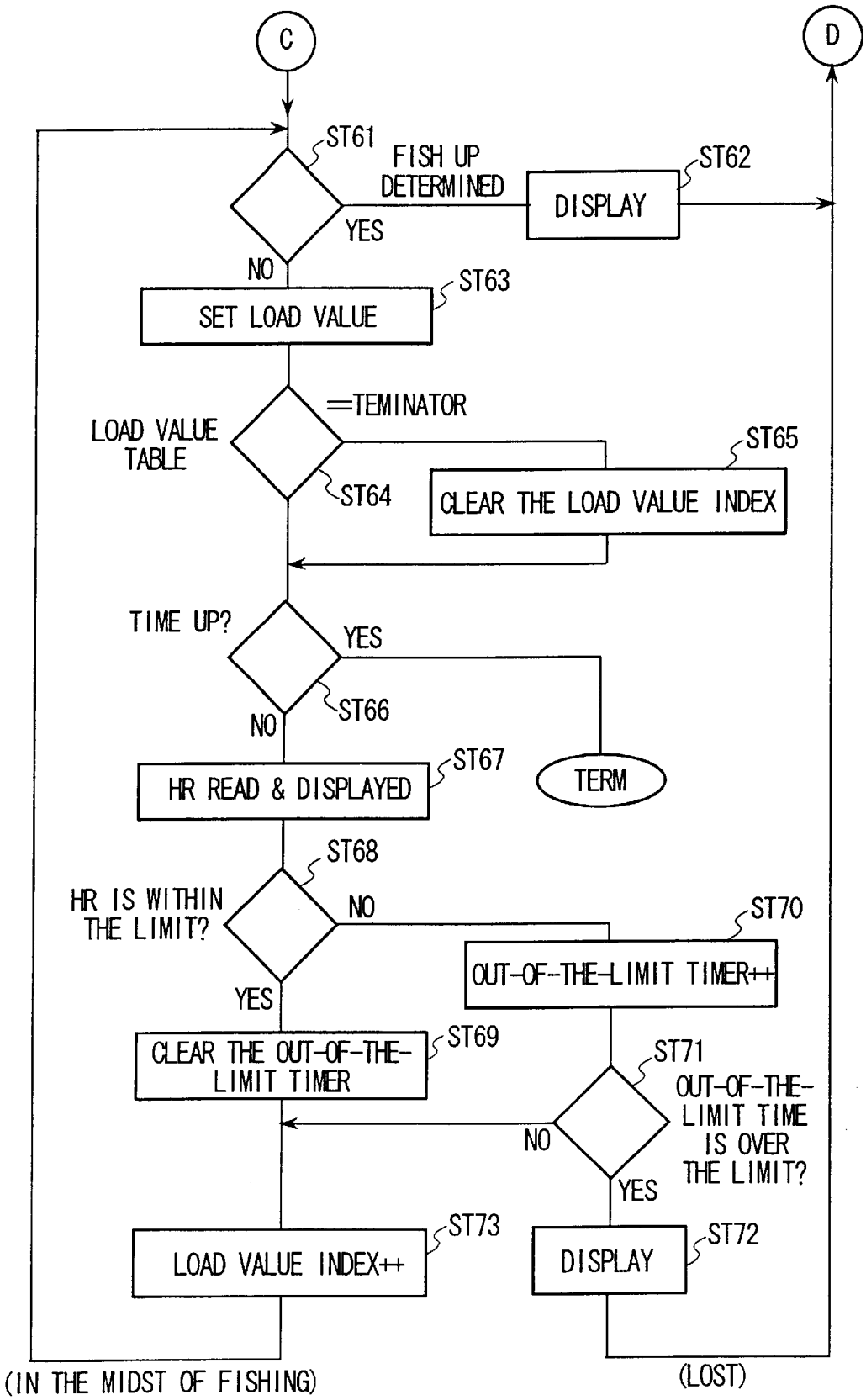
FIG. 23 is a flow chart of the training machine according to the second embodiment of the present invention.

FIG. 22 and FIG. 23 are each flowcharts explaining the operation of the training machine according to the second embodiment of the present invention. First, the data processing unit 27 performs initial processing, such as connection of the communication line or resetting of the hardware, and then displays a start message (ST51), and the display-audio output processing unit 27A reads out data on the opening music from the memory unit 24 outputs the opening music from a speaker 18 (ST52). After this, the setting of the reference range or the like for exercise by the exerciser is accepted via the operating unit 20. Then the time processing unit 27D initializes (clears) the within-the-limits timer and beyond-the-limits timer, and at the same time the load processing unit 27C clears the load value index which shows the position in the load table (ST53).

Then, according to the setting, the load processing unit 27C causes the load unit 13 to output a basic load (ST54). Upon this, the exerciser can start undertaking exercise.

With the start of exercise by the exerciser, the sensor unit 21 begins detecting various items of information. Then the sensor signal detection processing unit 27B detects the heart rate of the exerciser input from the sensor unit 21 and outputs it to the display-audio output processing unit 27A. The display-audio output processing unit 27A causes the display 17 to output the image, as seen in FIG. 21, showing the relationship between the input heart rate of the exerciser and the preset reference range in the heart rate information display area 17G shown in FIG. 10. Moreover, the display-audio output processing unit 27A reads out the image data for images up to the catching of the fish from the memory unit 24 and causes the display to display the images in the image display area 17A shown in FIG. 10 (ST55).

Then the sensor signal detection processing unit 27B compares the heart rate indicated by the heart rate data obtained from the sensor signal input processing unit 21D, with the reference range at the present moment (ST56). As a result, when the heart rate is outside the reference range, the sensor signal detection processing unit 27B judges that the exerciser is still in an improper exercise status, the time processing unit 27D clears the within-the-limits timer (ST57), and above-described ST55 and ST56 are carried out. On the other hand, when the heart rate belongs in the reference range, the time processing unit 27D continues the time measurement by the within-the-limits timer (ST58), and the display-audio output processing unit 27A detects whether the time measured by the within-the-limits timer has exceeded the predetermined time (ST59).

When the time has not exceeded the predetermined time, the above-described processes of ST56 to ST 58 are carried out. When it has exceeded the predetermined time, on the other hand, the display-audio output processing unit 27A, judging that the exerciser is now in a proper exercise status, shifts the display status of the exerciser to display status 2, which is the display status after display status 1, meaning a proper exercise status, reads out the image data corresponding to the above-described display status 2 from the memory unit 24 and outputs it to the display-voice output unit 16, thus causing the display 17 to output the image corresponding to display status 2, which is the image of a blue marlin caught and jumping above the water as shown in FIG. 13, and also causing the display 17 to output "FISH IS CAUGHT" in the character display area 17E by reading out the message indicating display status 2 from the memory unit 24.

Then the sensor signal detection processing unit 27B detects whether the number of revolutions detected by the revolution count sensor 21C has reached the predetermined number of revolutions (ST61). As a result, when the number/count of revolutions detected by the revolution count sensor 21C has reached the predetermined count/number of revolutions, the display-audio output processing unit 27A, judging that the exerciser is now in a proper exercise status and the intended purpose has been achieved, shifts the display status of the exerciser to display status 5, which is the display status after display status 2, reads out the image data corresponding to the display status 5, which is the image of a fish landed, from the memory unit 24 and outputs it to the display 17 (ST62), and then the above-described process from ST55 is carried out.

On the other hand, when the count has not reached the predetermined count, the load processing unit 27C reads out the load data indicated by the load index from the load table in the memory unit 24 and outputs it to the load unit 13 (ST63). The load unit 13 outputs the load corresponding to the input load data from the load unit 13A.

Then the load processing unit 27C detects whether the load data is the last data in the load table or not (ST64), and when it is the last data, clears the load index (ST65).

Then the time processing unit 27D detects whether the preset exercise time is up or not (ST66), and when it detects the time being up, the display-audio output processing unit 27A obtains various information from the database processing unit 27E and causes the display 17 to display an image, such as an image of evaluation during exercise, an image of comparing the past and present exercise data of the exerciser, or an image of ranking of evaluations of a plurality of exercisers, thus completing the process.

On the other hand, when it has detected that the time is not up yet, the sensor signal detection processing unit 27B detects the heart rate of the exerciser input from the sensor unit 21 and outputs it to the display-audio output processing unit 27A. The display-audio output processing unit 27A causes the display 17 to display the part containing the above-mentioned point of time of the image showing the relationship between the input heart rate of the exerciser and the preset reference range as shown in FIG. 21 in the heart rate information display area 17G shown in FIG. 10.

Moreover, the display-audio output processing unit 27A reads out from the memory unit 24 the image data for the image showing a proper exercise status or based on the total count of revolutions after the start of display status 2 input from the sensor signal detection processing unit 27B, that is, the image of a fish approaching, and causes the display 17 to display it. Also, when the message corresponding to the direction of change of heart rate and the difference of the heart rate with the boundary input by the sensor signal detection processing unit 27B is in the memory unit 24, the display-audio output processing unit 27A reads out the message from the memory unit 24 and causes the display 17 to display it in the character display area 17E as shown in FIG. 10 (ST67).

For example, when the change in heart rate from the sensor signal detection processing unit 27B is in the increasing direction and the difference with the upper limit of reference range has become smaller than the predetermined difference, the display-audio output processing unit 27A causes the display 17 to display "LINE IS NEAR THE LIMIT"; and when the difference of the heart rate with the upper limit of reference range has become even smaller within the predetermined difference, it will cause the display 17 to display "LINE IS VERY CLOSE TO THE LIMIT". By checking this display, the exerciser can acquire a correct grasp of the condition of his/her heart rate in relation to the predetermined reference range.

Then the sensor signal detection processing unit 27B compares the heart rate indicated by the heart rate data obtained from the sensor signal input processing unit 21D with the reference range at the present moment (ST68). As a result, when the heart rate is inside the reference range, the time processing unit 27D clears the beyond-the-limits timer (ST69).

On the other hand, when it is detected that the heart rate is outside the reference range, the time processing unit 27D continues the time measurement by the beyond-the-limits timer (ST70), the beyond-the-limits timer detects whether the extension time (e.g. 6 seconds) has been exceeded or not (ST71), and when it is detected that the extension time has been exceeded, the display-audio output processing unit 27A judges that the exerciser is in an improper exercise status, shifts the display status of the exerciser to display status 3 or display status 4, which is the display status after display status 2, meaning an improper exercise status, reads out the image data corresponding to display status 3 or display status 4 from the memory unit 24, and outputs it to the display-voice output unit 16, thus causing the display 17 to output the image and also causing the display 17 to output the message in the character display area 17E by reading out the message from the memory unit 24 (ST72). Then the above-described processes from ST53 are carried out.

According to the present embodiment, when the exerciser is in display status 4, the display-audio output processing unit 27A causes the display 17 to display the image showing the loss of a fish with the fishing line snapping as shown in FIG. 14 and the message "LINE SNAPPED AND THE FISH LOST" and when the exerciser is in display status 3, causes the display 17 to display the image showing a fish unhooked and gone as shown in FIG. 15 and the message "GOODNESS! YOU LOST THE FISH."

Then, when the time processing unit 27D has cleared the beyond-the-limits timer (ST69) or when it is detected that the extension time has not been exceeded (ST71), the load index is counted up (ST73) and the above-described processes from ST61 are carried out.

As has been described above, the training machine according to the second embodiment of the present invention provides the exerciser with the facility to easily and correctly grasp the relationship between his/her heart rate and the reference range, in addition to all the benefits to be given by the training machine according to the above-described first embodiment thereof.

Figure 24A:
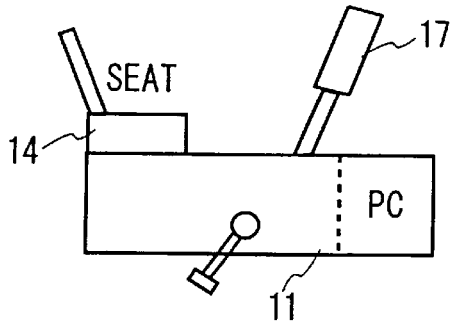
FIG. 24 is exemplary structure of the training machine according to the present invention.
Figure 24B:
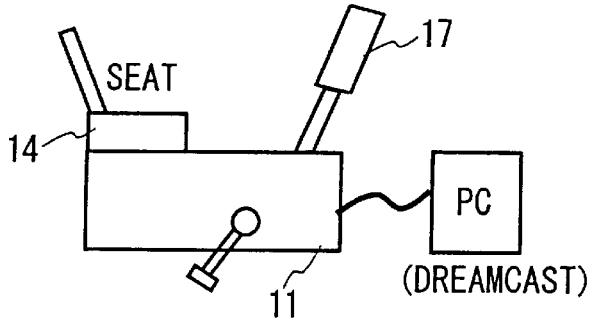

FIG. 24 shows examples of the configuration of the training machine according to the present invention. As seen in FIG. 24A, the training machine according to the present invention can be an integrated type in which the training machine body 11 is integrated with a PC which performs at least part of the function of the image output processing unit 41. Moreover, as seen in FIG. 24B, the training machine can be a type in which a PC, which performs at least part of the function of the image output processing unit 41, DreamCast or the like is connected to the training machine body 11 via a cable.

Figure 24C:
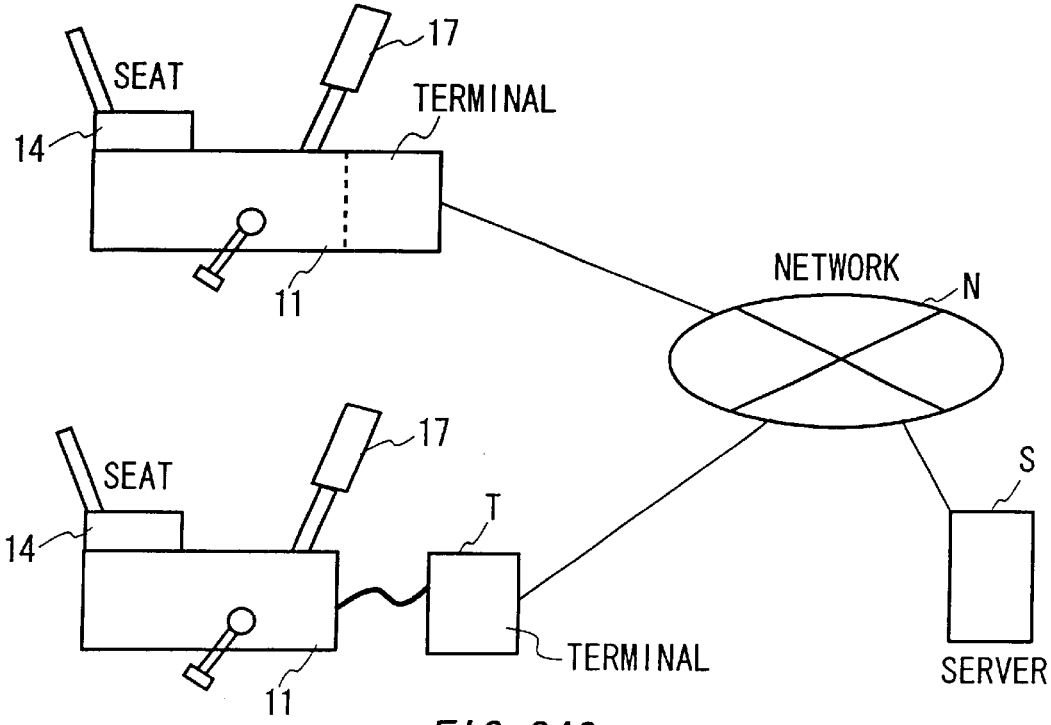

Moreover, as seen in FIG. 24C, the training machine can be structured so that the training machine body 11 is integrated with a terminal T or connected with a terminal T via a cable, and the terminal T is further connected with a server S, which performs at least part of the function of the image output processing unit 41, via a network N. For example, programs and images (graphics) can be stored in the server S, and the server S can be used to run a program, displaying images on the display 17 of the training machine body 11. Also, Information on the exercise undertaken by the exerciser can be transmitted from the training machine body 11 to the server S to have the server S perform the statistical processing of the exercise information. Furthermore, the server S can be used to perform the above-described processing for a plurality of training machine bodies 11.

The present invention is not limited to the embodiments described above but may be otherwise variously embodied. For example, a race or other forms of competition can be realized by the use of the communication device 26, which exchanges various data with other training machines. Moreover, by giving handicap in the setting for the exercise, the physically handicapped or injured persons, for example, can enjoy rehabilitation, participating in competition or the like with others.

Moreover, data gathered by the database processing unit 27E can be forwarded to a host computer via the communication device 26, so that the host computer can summate or compare the exercise records from a plurality of training machines, thus raising possibilities of holding various events (competitions) using a plurality of training machines. Moreover, remote maintenance of the training machine can be realized by transmitting and receiving maintenance information between a host computer and the training machine via the communication device 26.

Moreover, the IDs and exercise data of exercisers can be transmitted to a host computer by the use of the database processing unit 27E of the training machine and the communication device 26, so that the IDs and exercise data of the exercisers are managed by the host computer. Moreover, the ID of an exerciser can be read by the database processing unit 27E from the IC card inserted into the IC card reader/writer 25, and the ID of the exerciser is transmitted to the host computer via the communication device 26, so that the host computer can transmit the exercise data corresponding to the ID back to the training machine. With any of the identical training machines connected with a host computer as described above, the exerciser can have the training machine display his/her own exercise data by inserting his/her IC card into the IC card reader/writer 25.

Moreover, although the data control unit 27, the memory unit 24, the communication device 26 and the like according to the above-described embodiments are located inside the training machine body 11, the configuration of the training machine in the present invention is not limited thereto, but they can be installed outside of the training machine body 11.

Moreover, although the memory unit 24 is comprised of the ROM 24A and RAM 24B according to the above-described embodiments, the memory unit 24 is not limited thereto, but it can, for example, be comprised of a storing device, such as a magnetic disk device. Moreover, although the pulse rate sensor 21A and the body fat sensor 21B are located only on the pipe 30 according to the above-described embodiments, their location is not limited thereto, but they can be located on the handle 19 or on both the pipe 30 and handle 19. Moreover, although messages are output in images according to the above-described embodiments, the present invention is not limited thereto, but the messages can be output with sounds (voice).

Also, the configuration of the heart rate sensor 31A is not limited thereto, but it can be connected to the ear(s) of the exerciser or can be attached on the body of the exerciser, such as near the heart, as long as the heart rate of the exerciser can be detected.

Moreover, as the image data showing that the exerciser has entered a proper exercise status according to the above-described embodiments, a plurality of image data can be prepared in the memory unit 24, so that when the display-audio output processing unit has detected the exerciser being in a proper exercise status, an image data can, for example, be selected randomly from among the stored image data and output to the display 15. This gimmick, which prevents the display of the same image all the time, can help keep the exerciser interested in the exercise.

Moreover, in the above-described embodiments, the load data indicating the load to be output by the load unit 13 can be stored in the memory 24 in correspondence to the image data, so that when the image of the image data is displayed, the load unit 13 can generate the load based on the load data corresponding to the image data. The correspondence between the displayed image and the load the exerciser actually feels can give the exerciser a sense of being on the scene. It is also possible that the load is generated based on the load data, which are related only to some of plural images.

Moreover, although the information used for evaluation according to the above-described embodiments was the count of fish landed, the count of the exercise status shifting from a proper exercise status to an improper exercise status, the calories consumed in exercise, the wattage of exercise undertaken and the like, the present invention is not limited thereto, but the time of being in a proper exercise status or the amount of exercise undertaken in the proper exercise status can also be used, as long as the evaluation value can effect accurate evaluation according to the exercise undertaken.

Moreover, although the exercise is related to trolling and thus the images of trolling are displayed according to the above-described embodiments, the present invention is not limited thereto, but the exercise can be related to driving, hunting, flight or any other human activity in our everyday world or any of the activities in the world of games and the corresponding images can be displayed. Moreover, although the bike machine according to the above-described embodiments uses a revolution count sensor 21C for measuring the amount of exercise undertaken, it can use such a device as a photoelectric sensor, photo-microsensor, proximity sensor, ultrasonic sensor, rotary encoder, pressure sensor, displacement sensor, length-measuring sensor, provided that the device can measure the information necessary to determine the amount of exercise undertaken.

Moreover, although the above-described embodiments showed a bike machine as an example of the training machine, the present invention is not limited to the bike machine, but it can be applied to other training machines, such as tread mill, chest press, shoulder press, rowing machine and the like.

As is clear from the above descriptions, the present invention can help the exerciser know easily and correctly whether the exercise being undertaken is proper or not for him/her. Also, the present invention allows the exerciser to take the exercise effectively by checking the displayed image which can be changed according to the physical information on the exerciser.

According to the present invention, the exerciser can carry out a desirable exercise by merely playing and scoring the game, while in the conventional art, the exerciser needs to consider the proper amount of exercise for a desirable training.

Although the present invention has been described by way of exemplary embodiments, it should be understood that many changes and substitutions may be made by those skilled in the art without departing from the spirit and the scope of the present invention which is defined only by the appended claims.

What is claimed is:

1. A recording medium which stores a program to be executed by a computer, images associated with exercise for plural types of exercisers and a reference range related to the body information of the exerciser, the program comprising:

an input program which inputs body information that changes with the exercise of the exercisers;

state detection program which detects whether the body information input by the input program belongs to the reference range, for plural times within a predetermined time duration, and detects, based on detection results carried out for plural times and change of the body information, whether an exercising state of the exerciser is proper; and an output program which outputs the image corresponding to the proper state or the improper state detected by the state detection program, from plural types of the images so as to be output.

2. A recording medium which stores a program to be executed by a computer, a sequence indicating the order of a plurality of display statuses specifying a displayed image, and an image of activity associated with exercise of an exerciser associated with said each display status; the program comprising:

an input program which inputs body information that changes as the exerciser exercises;

a transition detecting program which detects by using the computer, based on the body information input by executing said input program of the computer, whether the present display status is to be transited to a display status of the next sequence; and an output program which transits the present display status to the display status of the next sequence in said sequence, by executing said transition detecting program when the transition detecting program detects that the status is to be transited to the next display status, and which outputs the image associated with the transited display status.

* * * * *